US005660486A

United States Patent [19]

Okuda et al.

[11] Patent Number: 5,660,486

[45] Date of Patent: Aug. 26, 1997

[54] IMAGE PRINTING APPARATUS AND IMAGE PRINTING METHOD

[75] Inventors: Masakazu Okuda; Yasuhiro Otsuka, both of Tokyo, Japan

[73] Assignee: NEC Corporation, Japan

[21] Appl. No.: 447,798

[22] Filed: May 23, 1995

[30] Foreign Application Priority Data

May 24, 1994 [JP] Japan ..... 6-108848
Jun. 13, 1994 [JP] Japan ..... 6-129986

[51] Int. Cl.[6] ..... B41J 2/36

[52] U.S. Cl. ..... 400/120.07; 400/120.09; 101/489; 346/76.1; 347/183; 347/205

[58] Field of Search ..... 101/487, 489; 400/120.01, 120.07, 120.09, 120.12, 120.13; 346/76.1; 347/183, 205, 188, 171

[56] References Cited

U.S. PATENT DOCUMENTS

| | | | |
|---|---|---|---|
| 3,824,098 | 7/1974 | Bergman, Jr. et al. . | |
| 3,899,969 | 8/1975 | Taylor | 101/130 |
| 3,935,327 | 1/1976 | Taylor . | |
| 3,992,204 | 11/1976 | Taylor | 347/171 |
| 4,106,933 | 8/1978 | Taylor | 427/100 |
| 5,153,615 | 10/1992 | Swelling | 346/76.1 |
| 5,185,619 | 2/1993 | Snelling . | |
| 5,353,105 | 10/1994 | Gundlach et al. | 355/279 |
| 5,533,816 | 7/1996 | Ikeda et al. | 400/120.07 |

FOREIGN PATENT DOCUMENTS

| | | |
|---|---|---|
| 0510963 | 10/1992 | European Pat. Off. . |
| 56-158350 | 12/1981 | Japan . |
| 5-134506 | 5/1993 | Japan . |

OTHER PUBLICATIONS

J.G. Bergman, et al, "Pyroelectric Copying Process", Appl. Phys. Lett., vol. 21, No. 10, 1972, pp. 497–499.

*Primary Examiner*—Eugene H. Eickholt
*Attorney, Agent, or Firm*—Ostrolenk, Faber, Gerb & Soffen, LLP

[57] ABSTRACT

An image printing device includes a latent image charge keeping medium including a pyroelectric layer, a thermal head for selectively heating the charge keeping medium according to a signal, and an electrically conductive film disposed to be brought into contact with or to be in the vicinity of a surface of the pyroelectric layer of the medium for being heated by the thermal head, thereby neutralizing charge appearing on the medium due to pyroelectric effect. The device further includes a developer for visualizing with a charged coloring medium an electrostatic latent image formed on the medium, a transfer roller for transferring the developed image onto a sheet of printing paper, and a fixing device for fixing the transferred image on the printing sheet. The conductive layer is applied with a bias voltage from a power source such that a strong absorbing force acts upon charge, thereby efficiently neutralizing the charge. There are attained a high printing density and a favorable uniformity in the printing density.

19 Claims, 14 Drawing Sheets

IMAGE PRINTING APPARATUS AND IMAGE PRINTING METHOD

BACKGROUND OF THE INVENTION

The present invention relates to an image printing apparatus and, in particular, to an image printing apparatus applicable to a printer, facsimile equipment, a copying machine, an indicator board, and the like. More specifically, the present invention relates to an image printing apparatus in which an electrostatic latent image formed according to pyroelectric effect is developed with an electrically charged coloring medium so as to form an image on a printing medium.

Description of the Related Art

According to known conventional methods, a pyroelectric material which generates, when heated, electric charge on surfaces thereof is employed to form an electrostatic latent image so as to obtain a visible image from the latent image by using an electrically charged coloring material, thereby printing images.

For example, a copying device using polymeric polyvinylidene fluoride (PVDF) as the pyroelectric material has been described in the U.S. Pat. No. 3,824,098 of J. G. Bergman et al. In the apparatus, as can be seen from FIG. 1, light illuminated from a lamp, i.e., a light source 79 is passed through a sheet of manuscript 78 to be radiated onto a laminated plate including a pyroelectric layer 76 and an electrically conductive layer 77, thereby heating the plate according to an image pattern formed by the light. Thanks to pyroelectric effect, electric charge of the latent image appears on the surface of the pyroelectric material, layer 76. The image is developed with electrically charged particles of toner 80 to obtain a toner image. The image is then transformed onto a sheet of printing paper or the like to attain a copied image of the manuscript.

J. G. Bergman et al have described production of a latent image with electric charge of opposite polarity in pages 497 to 499 of "Applied Physics Letters", Vol. 21 (10) published in 1972. According to the article, immediately after a pyroelectric material is heated (or while a pyroelectric material is being heated), when the electric charge produced on the surface of the pyroelectric material is neutralized, electric charge of a polarity opposite to that appearing in the heated or heating condition is produced on the surface. The attained opposite-polarity charge forming a latent image can be kept in a stable state for a long period of time and is hence more advantageous when compared with the charge generated in the heating state. In this connection, the latent image resultant from the above process will be referred to as "latent image due to opposite-polarity charge" in this specification.

In the Japanese Patent Laid-Open Publication No. 56-158350 of Yamazaki et al, there has been described a method of heating a pyroelectric material by a laser light or thermal head. This printing method also utilizes the formation of a latent image with opposite-polarity charge appearing when the pyroelectric material is cooled.

In the conventional examples of Bergman and Yamazaki, although description has been given of the creation of a latent image with opposite-polarity charge, there has not been described any specific means for creating the latent image due to opposite-polarity charge. On the other hand, in the U.S. Pat. No. 3,935,327 of A. L. Taylor, there has been described a method in which electric charge neutralizing means using an electrically conductive bush is employed to electrically neutralize in a positive fashion a surface of a pyroelectric material being heated.

Furthermore, in the Japanese Patent Laid-Open Publication No. 5-134506 and U.S. Pat. No. 5,185,619, C. Snelling has proposed a method of electrically and efficiently neutralizing electric charge appearing on a surface of a pyroelectric material according to his recognition that the quantity of opposite-polarity charge (charge density of the latent image) is substantially equal to that of neutralizing charge in the heating state. In this method, a thermal print stylus is employed as the means of heating the pyroelectric material. On a surface of the needle, there is arranged an electrically conductive layer to be grounded such that the electric charge generated in the heating state is efficiently neutralized through the conductive layer.

Referring now to FIG. 2, description will be given of the basic configuration of the image printing device proposed by Snelling. In the device, a belt-shaped medium 93 for keeping thereon electric charge of a latent image includes a pyroelectric layer 94 and an electrically conductive layer 95. Disposed on the pyroelectric layer 94 is a heating needle 96, which selectively heats a surface of the pyroelectric layer 94 according to a signal under control of a controller 98. Disposed on a surface of the heating needle 96 is a grounded conductive layer 97 through which charge collected on the surface of the pyroelectric layer 94 is neutralized. When the medium is cooled, electric charge of a polarity opposite to that of charge generated in the heating state is produced to form a latent image 99. The latent image 99 is developed with toner by a developer 100 such that the developed image is transformed onto a printing medium 102 by transfer means (pyroelectric effect is used also in the transfer means according to Snelling).

As above, when forming an electrostatic image according to pyroelectric effect, in order to obtain a sufficient charge density of the latent image due to opposite-polarity charge, it is essential to effectively neutralize the charge appearing in the pyroelectric material heating state.

In the method of Snellng, an electrically conductive layer is required to be arranged on a surface of the heating means. However, it is difficult to fabricate an array of heating elements densely arranged therein. In addition, the conductive layer on the heating means cannot be uniformly brought into contact with the surface of the pyroelectric layer in a simple procedure. Namely, the printing density easily becomes non-uniform. Moreover, when the conductive layer on the heating means is brought into contact with the surface of the pyroelectric layer, the conductive or pyroelectric layer is worn due to friction therebetween, which makes it difficult to guarantee endurance and reliability of the apparatus.

As described above, to obtain a high image quality in the printing operation in which the latent image is produced with opposite-polarity electric charge, it is essential to uniformly neutralize electric charge when the pyroelectric material is heated (to form the latent image). Particularly, in case where the quantity of heat created by the heating means is controlled to vary the heating temperature of the pyroelectric layer so as to produce a gray-scale continuous tone image, electric charge is required to be neutralized in a highly uniform state. That is, since the potential of the latent image cannot be modulated according to the heating temperature when the electric neutralization is non-uniformly accomplished, the gray-scale image printing cannot be carried out with a uniform and stable density. In consequence, the uniform electric neutralization is essential for the gray-scale image printing operation requiring a high picture quality.

However, the conventional neutralizing method is attended with difficulty in obtaining a sufficiently uniform electric neutralization. For example, in the example of the prior art shown in FIG. 2, charge neutralizing means (conductive layer 47) cannot be fully brought into contact with a pyroelectric layer 44 and hence the uniform neutralization is not easily effected. In other words, due to projections and depressions on surfaces respectively of the neutralizing means and pyroelectric layer, it is quite difficult to satisfactorily bring the surface of the neutralizing means into that of the pyroelectric layer. Consequently, non-uniformity of contact therebetween easily appears as unevenness in the printing density. Particularly, an intermediate tone having a uniform density cannot be easily reproduced. As a countermeasure to improve the state of contact, there can be considered, for example, a method in which the surfaces respectively of the neutralizing means and pyroelectric layer are fabricated with quite a high surface precision with respect to flatness and surface roughness or a method in which the neutralizing means and pyroelectric layer are pushed against each other with a high pressure to be closely fixed onto each other by use of elastic deformation. However, these methods are attended with problems of increase in the production cost and size (for high rigidity) of the apparatus and hence cannot be readily employed in actual practices.

In addition to insufficiency of uniformity in charge neutralization, there has been a problem of difficulty in obtaining a satisfactory neutralization efficiency in the conventional charge neutralizing method. That is, the neutralization is required to be carried out in quite a short period of time in which temperature of the pyroelectric layer is increased. Consequently, it is necessary to accomplish the charge neutralization with considerably a high efficiency. However, in the conventional example of the apparatus of Snelling as shown in FIG. 2, the charge neutralizing means is grounded and hence a strong electric field is missing in the neutralizing zone, leading to difficulty in attaining a high neutralizing efficiency. Particularly, in a high-speed printing operation, the neutralizing performance becomes insufficient and hence it is difficult to obtain a satisfactory printing density (charge density of the latent image).

Furthermore, conventional image printing apparatuses have been attended with a problem of insufficiency in the gradation printing characteristic when achieving the gray-scale printing. Namely, in an image printing apparatus using a pyroelectric material, the gradation of density can be controlled in the unit of printing pixels by controlling heat produced by the heating means. However, due to an upper-limit of temperature (Curie temperature) allowed for the pyroelectric substance, the number of feasible gradation steps is also limited in consideration of controllability of temperature of the heating means.

For example, Curie temperature of PVDF which is a polymeric substance generally utilized as the pyroelectric material is about 120° C. When the temperature of PVDF exceeds this value, the pyroelectric characteristic thereof is deteriorated or is completely vanished. Ordinarily, it is considered that PVDF functions with a stable characteristic at an upper-limit temperature of about 90° C. Assume that the heating temperature (lower-limit temperature) to record an image with the lower-most density is set to 40° C. The dynamic range of heating temperature is then attained as 90–40=50 (° C.). Assume now that the gray-scale printing is carried out with 64 levels of gradation. In this case, the range of temperature from 0° C. to 50° C. is controlled in 64 sub-ranges with respect to temperature. This namely requires a highly precise control operation of temperature with precision of ±0.4° C. However, such a precise control of the heating temperature is attended with difficulty in practices. Even when a thermal head for which the temperature can be easily controlled with a high precision is employed as the heating means, the temperature control operation is limited to ±1° C. in ordinary cases. Consequently, in this situation, the number of controllable levels of gradation is 50÷2=25, leading to difficulty in printing signals with a high fidelity.

As above, according to the image printing devices of the prior art, it has been difficult to attain a satisfactory gradation printing characteristic due to the limited range of temperature allowed for pyroelectric substances.

SUMMARY OF THE INVENTION

It is therefore an object of the present invention to provide an image printing apparatus and an image printing method in which electric charge can be more uniformly and more efficiently neutralized when forming a latent image so as to conduct a gray-scale printing with a high image quality at a high speed, thereby solving the problems above.

To achieve the objects above in accordance with a first aspect of the present invention, there is provided an image printing apparatus comprising a latent image charge keeping medium including a pyroelectric layer, heating means for selectively heating the charge keeping medium according to a signal, and charge neutralizing means disposed to be brought into contact with or to be in the proximity of a surface of the pyroelectric layer of the charge keeping medium for being heated by the heating means, thereby neutralizing charge appearing on the charge keeping medium due to pyroelectric effect.

The image printing apparatus in accordance with the present invention further includes developing means for visualizing with a charged toning medium an electrostatic latent image formed on the charge keeping medium and transfer means for transferring the developed image onto a printing medium. The charge neutralizing means includes an electrically conductive film.

In the image printing apparatus in accordance with the present invention, the electrically conductive film is being relatively moved, in a process of forming a latent image on the charge keeping medium or in a process of heating the charge keeping medium, relative to the heating means in a same direction in which the charge keeping medium is moved.

In the image printing apparatus in accordance with the present invention, the electrically conductive film includes a film configured in the form of an endless contour.

In the image printing apparatus in accordance with the present invention, the electrically conductive film includes a film configured in the form of a belt.

Furthermore, in the image printing apparatus in accordance with the present invention, the electrically conductive film is made of a polymeric substance to which electrically conductive fine particles are added.

In the image printing apparatus in accordance with the present invention, the electrically conductive film is of a laminated configuration including at least a thin film layer made of an electrically conductive material and a layer made of a polymeric substance for supporting the thin film layer.

Moreover, in the image printing apparatus in accordance with the present invention, the electrically conductive film includes a layer made of a thermally anisotropic material having higher thermal conductivity in a direction of thickness of the layer.

In the image printing apparatus in accordance with the present invention, a surface of the electrically conductive film to be brought into contact with the charge keeping medium is made of an electrically conductive substance having high flexibility equivalent to a gum rigidity of 60 degrees or less.

Additionally, in the image printing apparatus in accordance with the present invention, the heating means is a thermal head including heat producing small elements of which temperature is increased according to Joule heat.

In the image printing apparatus in accordance with the present invention, the heating means is a laser beam controlled according to the signal.

Also, in the image printing apparatus in accordance with the present invention, the charge keeping medium includes a film configured in the form of an endless contour, the film including a pyroelectric layer and an electrically conductive layer.

In the image printing apparatus in accordance with the present invention, the charge keeping medium includes an electrically conductive drum and a pyroelectric layer fabricated on a surface of the drum.

The image printing apparatus in accordance with the present invention further includes means for applying a bias voltage to the charge neutralizing means for generating an absorbing or repulsive force for excessive charge on the surface of the pyroelectric layer.

The image printing apparatus in accordance with the present invention further includes means for sensing temperature of the heating means and means for controlling a value of the bias voltage applied to the charge neutralizing means according to data of temperature sensed by the sensing means.

In addition, the image printing apparatus in accordance with the present invention further includes means for applying an alternating-current voltage to the charge neutralizing means.

In the image printing apparatus in accordance with the present invention, the voltage applying means applies, in addition to the alternating-current voltage, a direct-current voltage component to the charge neutralizing means, the direct-current voltage component being superimposed onto the alternating-current voltage.

Furthermore, in the image printing apparatus in accordance with the present invention, the voltage applying means includes sense means for sensing information of at least one of temperature in the apparatus, humidity in the apparatus, and base temperature of the heating means and voltage control means for controlling a voltage value of the direct-current voltage component according to the sensed information.

In accordance with the present invention, there is provided an image printing method of printing an image by the image printing apparatus, comprising the steps of subdividing data of the image into a plurality of sets of image data according to density of pixels to be recorded and controlling for each of the image data sets the bias voltage and an amount of heat produced by the heating means and achieving a plurality of times a process of forming an electrostatic latent image for each of the image data sets, thereby printing the image data having gradation levels of density.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
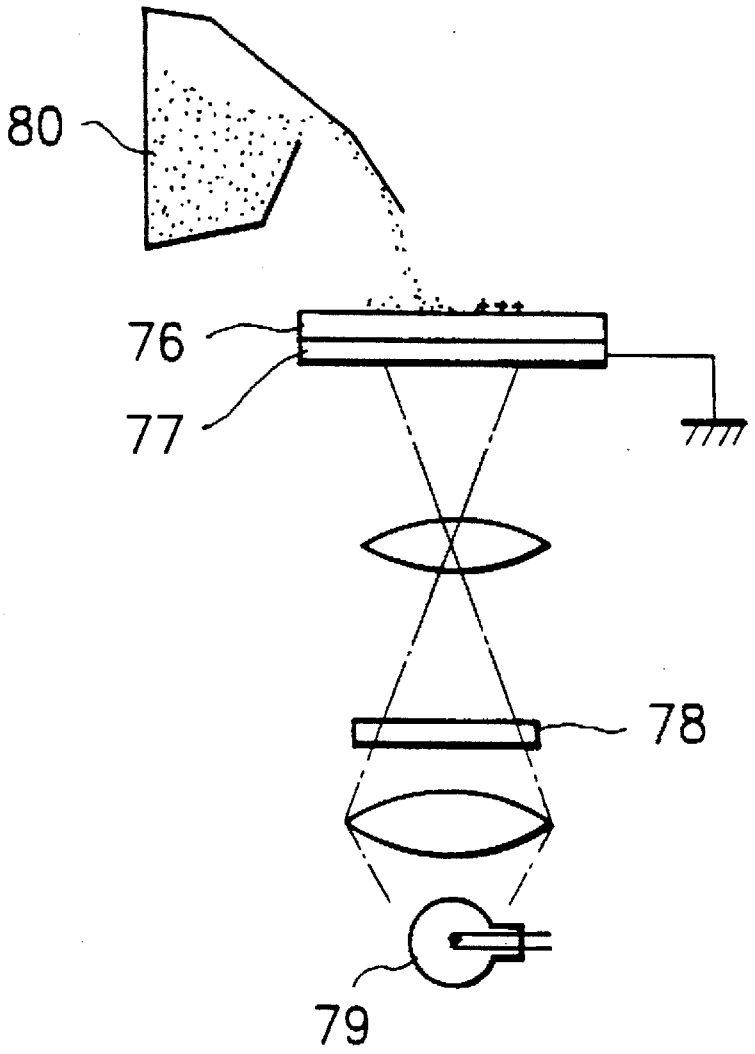
FIG. 1 PRIOR ART
FIG. 1 is a diagram for explaining the principle of a conventional copying machine using a lamp to heat the pyroelectric substance.
Figure 2:
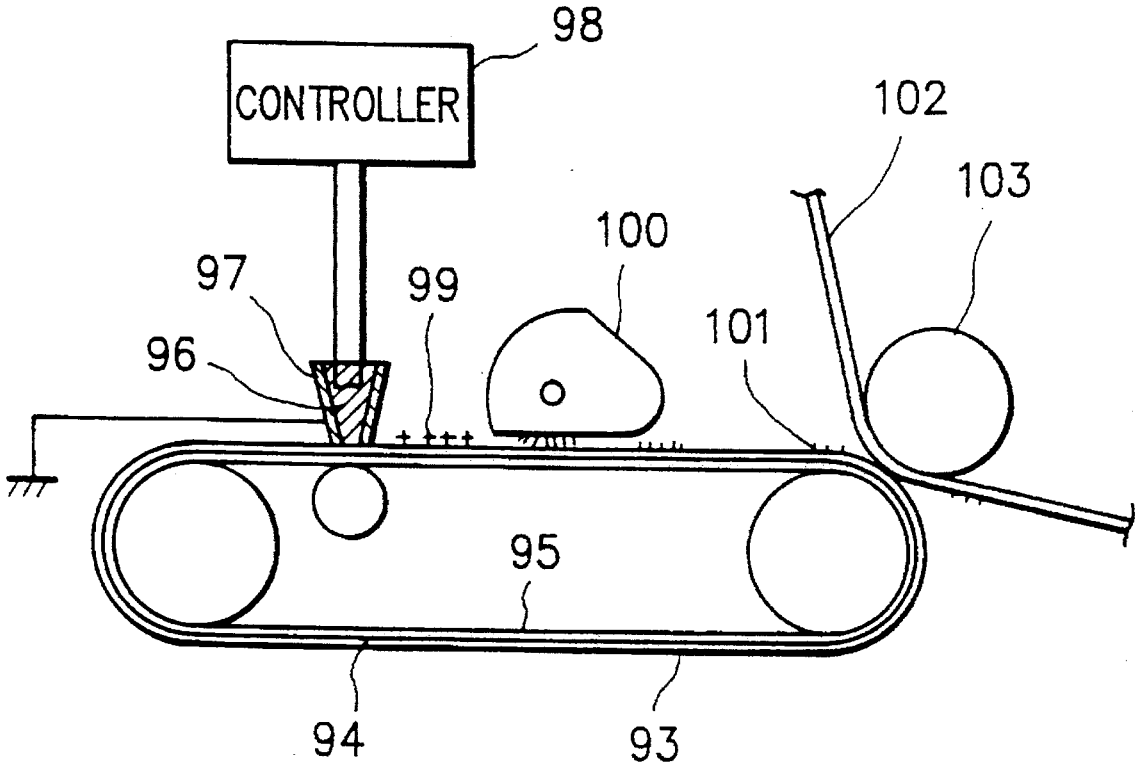
FIG. 2 PRIOR ART
FIG. 2 is a diagram for explaining constitution of a conventional image printing device using charge neutralizing means grounded.
Figure 3:
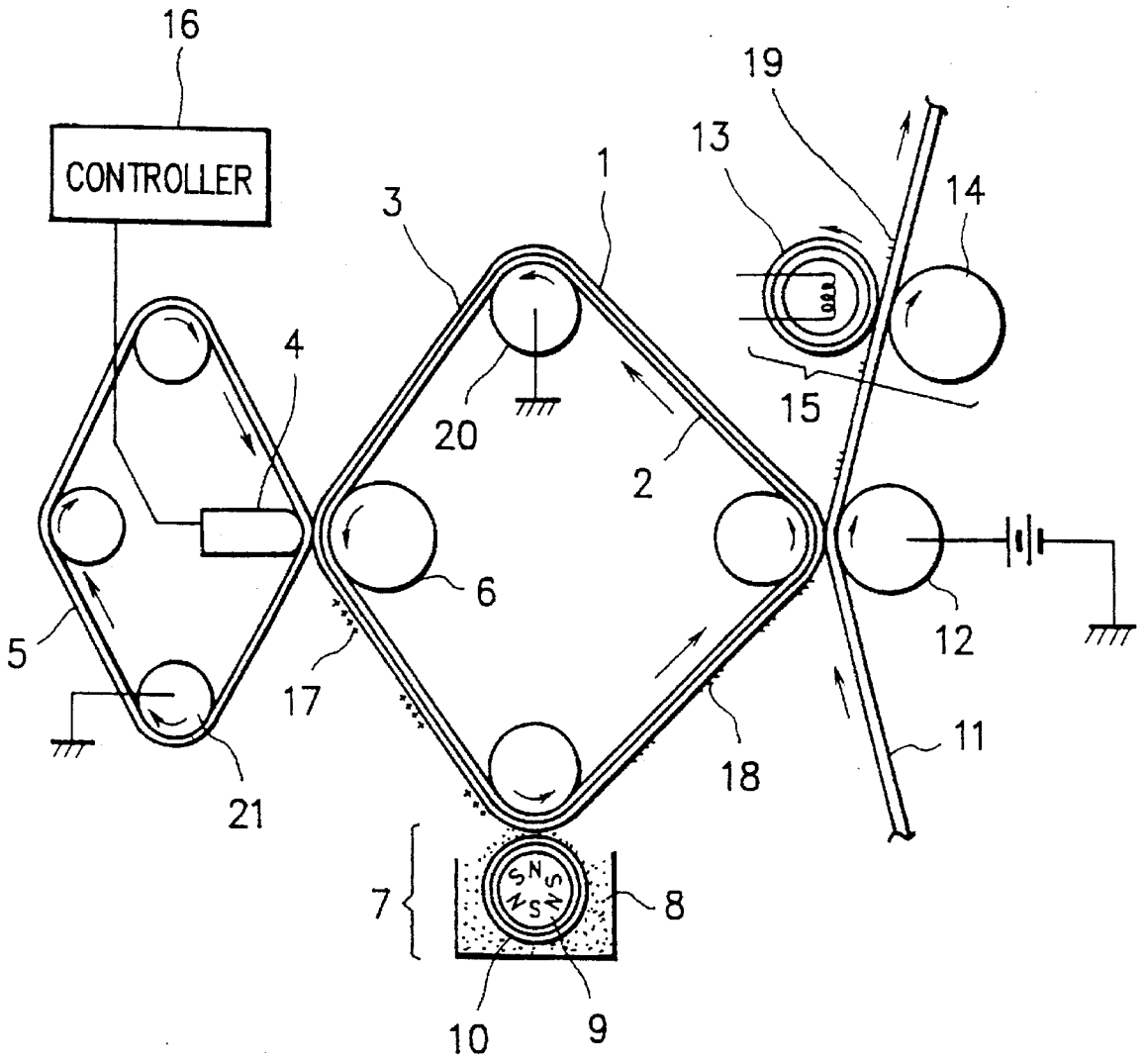
FIG. 3 is a diagram schematically showing a first embodiment of the present invention.

Referring to the drawings, description will be given of the present invention. FIG. 3 shows constitution of a first embodiment according to the present invention. The image printing device of this embodiment shown in FIG. 3 includes a latent image charge keeping medium 3 including a pyroelectric layer 1, a thermal head 4 as heating means for selectively heating the medium 3 according to a signal, a conductive film 5 configured in an endless contour which is brought into contact with a surface of the pyroelectric layer 1 on the medium 3 or which is disposed in the proximity of the surface of the pyroelectric layer 1 and is heated by the thermal head so as to neutralize charge appearing on the medium 3 according to pyroelectric effect, a developing device 7 to visualize an electrostatic latent image on the medium 3 with a electrically charged toning medium, a transfer roller 12 for transferring the developed image onto a sheet of printing paper 11, and a fixing device 15 for fixing the transferred image on the printing sheet 11.

Next, the principle of the present invention will be described. The pyroelectric layer of the charge keeping medium contains polarized charge due to spontaneous polarization. Initially, the surface charge is in a neutralized state. That is, for example, floating charge in the air or charge supplied from neutralizing means such as a conductive brush attaches or fixes onto the surface of the pyroelectric layer to form an electrically neutral state. In the following description, it is assumed that the polarized charge generated on the surface of the pyroelectric layer due to spontaneous polarization of the pyroelectric material has the positive polarity and a comparable amount of true effective charge having the negative polarity fixes onto the surface of the pyroelectric layer to establish an electrically neutralized state as the initial state.

The charge keeping medium is locally heated by the heating means according to a signal. In the heated position of the medium, the state of orientation of molecules is altered to reduce the amount of polarized charge appearing on the surface of the pyroelectric layer. In consequence, the amount of negative-polarity charge accumulated on the surface becomes excessive. Resultantly, the surface is negatively charged.

However, since the grounded conductive film is brought into contact with the surface of the pyroelectric layer or is in the neighborhood thereof, the excessive charge on the surface is immediately removed through the conductive film. As a result, the surface of the pyroelectric layer is neutralized again.

When the heating is finished and the charge keeping medium is cooled to the initial temperature, the state of polarization is also restored to the original state in the pyroelectric layer. In this situation, the surface of the pyroelectric layer has already been separated from the conductive film and hence the negative charge is insufficient on the surface. Virtually, the surface is positively charged. That is, in the heated portion of the cooled medium, there is created a positive-polarity latent image. As above, the latent image is produced with charge having a polarity reverse to that of the polarized charge of the pyroelectric layer and hence is called "latent image by opposite-polarity charge" in this specification.

Although the latent image produced with the opposite-polarity charge is gradually obscured because floating charge in the air fixes onto the image, the phenomenon takes considerably a long period of time in general. Namely, the latent image is kept remained for several hours to several tens of hours in ordinary cases.

When the medium in which the latent image is generated is brought into or is in the neighborhood of a charged toning medium, particles of the toning medium are selectively fixed onto the surface of the pyroelectric layer to thereby develop a visual image. The coloring medium particles fixed onto the charge keeping medium are then transferred and fixed onto a printing medium to form a desired image thereon.

The charge keeping medium 3 is a belt of a film including two layers, namely, a pyroelectric layer 1 (about 30 micrometer (μm) thick) and a conductive layer 2 (about 0.05 μm thick). The film is configured in an endless form as shown in FIG. 3. The layers 1 and 2 are made of PVDF and aluminum, respectively. The conductive layer 2 is continuously kept at a grounding potential via a conductive roller 20.

The thermal head 4 as the heating means is a line-type thermal head generally utilized in a thermal transfer printer. The thermal head 4 is configured such that fine elements generating Joule heat are repeatedly arranged with a pitch of about 83 μm (300 dots/inch) along a line in the direction of width of the medium 3. These heating elements are selectively activated by a controller 16 in response to signals to heat the charge keeping medium 3. The medium heating operation is accomplished in a state in which the medium 3 and conductive film 5 are interposed between the thermal head 4 and platen roller 6. In this connection, the thermal head 4 is not limited to the line-type thermal head used in this embodiment. Namely, there may be adopted a serial-type thermal head.

On the surface of the pyroelectric layer 1 of the heated medium 3, there is generated charge (excessive charge described above) due to pyroelectric effect. However, the charge is instantaneously neutralized through the conductive film 5 tightly attached onto the surface of the pyroelectric layer 1. The conductive film 5 of the embodiment is made of a heat-resistive polymer, polyaramid (about 15 μm thick). A small amount of carbon particles are added the film material to develop conductivity equivalent to $10^3$ to $10^4$ ohm (Ω). Thanks to addition of conductive particles to the polymer constituting the conductive film 5, there are easily attained the sufficient mechanical strength and conductivity suitable for neutralization of charge.

When producing a latent image, the conductive film 5 is conveyed in the same direction and at the same speed as those of the charge keeping medium 3 for the following reason. Namely, without this provision, the surface of the conductive film 5 is pushed by the pressure between the thermal head 4 and the platen roller 6 for a long period of time and there appears quite a long period of friction between the surface and the charge keeping medium 3. However, in case where a sufficient strength against friction and a satisfactory mechanical strength are provided for the conductive film 5, the conductive film 5 need not be necessarily transported as above. Namely, the film 5 may be fixedly attached onto the surface of the heating means in such a case.

After the cooling is finished, the medium 3 is left standing so that the temperature thereof returns to the room temperature through the natural cooling, thereby forming a latent image with opposite-polarity charge. In this regard, the medium 3 may be forcibly cooled or there may be employed forcible cooling means such as a heat sink.

The latent image 17 created on the medium 3 is developed by the developer 7. In this embodiment, the developer 7 operates in a developing method using the two-component magnetic brushing. That is, there is employed a developing agent 8 in which insulating and non-magnetic toner particles are mixed with magnetic carrier particles to electrically charge the toner particles through friction therebetween so as to attach the charged toner particles onto the surface of carrier particles. The developing agent 8 is retained on a sleeve 10 containing therein a magnet roller 9 and is thereby brought into contact with the charge keeping medium 3. In this state, the toner particles are selectively fixed onto the surface of the medium 3 according to the distribution of charge thereon, thereby obtaining a visual image.

After the developing process, with the medium 3 fixed onto a printing sheet of paper 11 as the printing medium, a transfer roller 12 applied with an appropriate voltage is pushed against the rear surface of the printing sheet 11 to electrostatically transcribe toner 18 onto a surface of the sheet 11. For the electrostatic transcription of toner 18, the roller 12 includes a conductive gum roller applied with a voltage of about +1 kilovolt (kV).

When the sheet 11 onto which the toner 18 is transferred is passed through a fixing apparatus 15 including a heat roller 13 and a pressure roller 14, the toner 18 is once melted on the surface of the printing sheet 11 to be fixed onto the sheet 11, thereby producing a desired record image 19.

In this connection, the latent image developing method, kind of the developing agent, transcribing method of the latent image onto the printing medium, and method of fixing the image onto the printing medium are not restricted by those used in the embodiment. Namely, any other methods employed in conventional electronic photography can be also used to obtain the similar advantageous effect.

After the toner 18 is transferred onto the printing sheet 11, the charge keeping medium 3 is transported again to the latent image creating section (thermal head section) to generate another latent image. Prior thereto, if there exists any toner which has not been transferred onto the sheet 11 and which remains on the medium 3, a cleaner (not shown) is used to remove the remaining toner when necessary.

Furthermore, a portion of charge of the latent image may possibly remain on the medium 3 after the toner 18 is transferred onto the sheet 11. In such a situation, for example, a conductive brush (not shown) connected to the ground potential is brought into contact with the surface of the pyroelectric layer 1 to easily neutralize the latent image charge thereon. Additionally, since the charge keeping medium 3 is brought into contact with the conductive roller 5, the remaining charge can also be completely neutralized in this operation. Namely, a favorable picture free of influence (ghost, etc.) of the remaining charge of the latent image can be created without arranging any particular means for electrically neutralizing the latent image charge.

Results of printing experiments using the configuration above have shown that an image can be recorded on an ordinary sheet of paper having a relatively rough surface with a high image quality (resolution of 300 dpi and image optical density (OD) value of about 1.4). Moreover, according to continuous printing experiments, it has also been recognized that the successive printing operation of images free of ghost images can be favorably carried out without using any special means to neutralize charge of the latent image while guaranteeing sufficient durability and reliability of the image printing apparatus.

Figure 4:
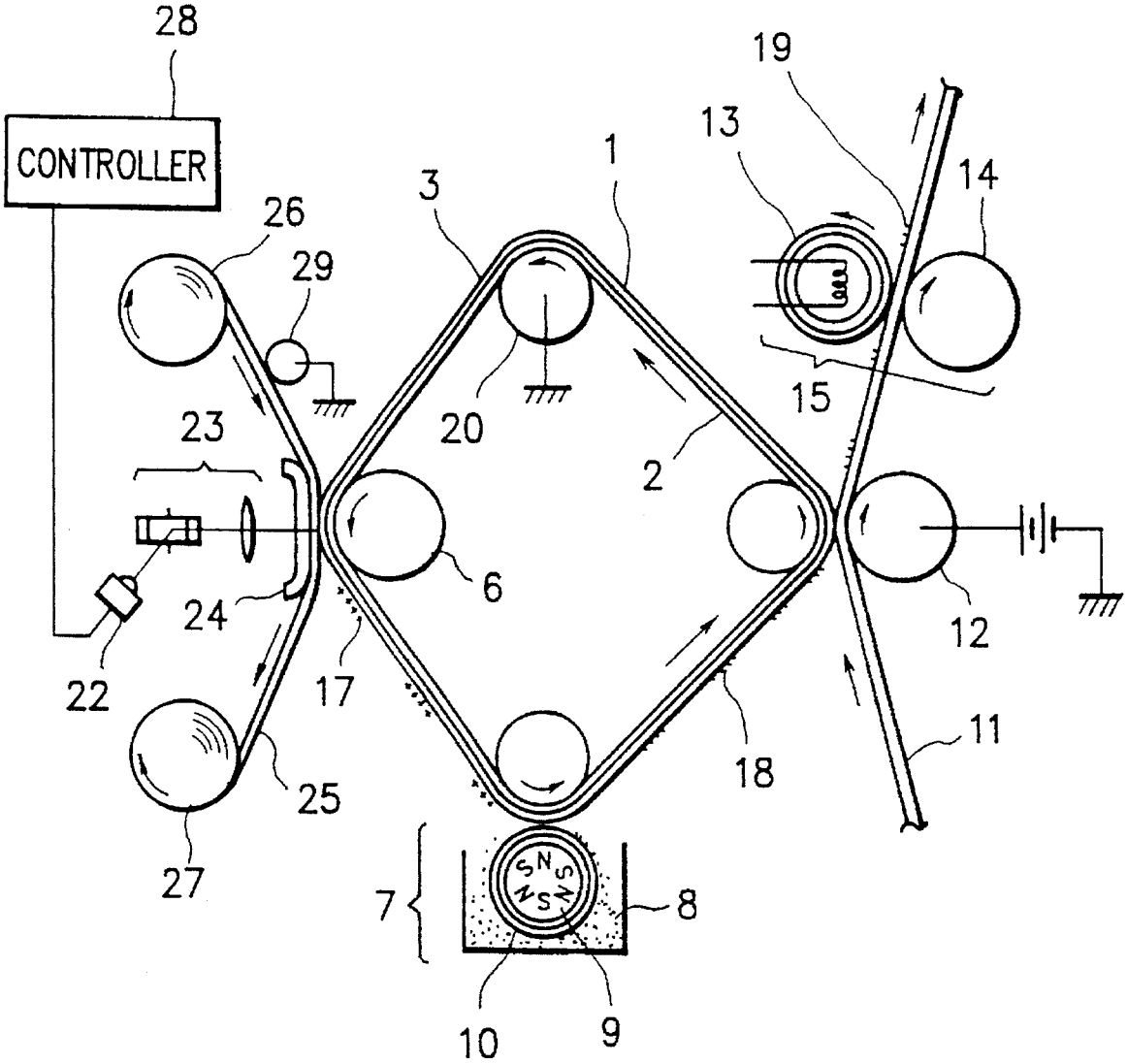
FIG. 4 is a diagram showing a second embodiment of the present invention.

FIG. 4 shows constitution of a second embodiment according to the,present invention. A laser beam and a band-shaped film are adopted as the heating means and the conductive film, respectively. Other constituent components are the same as those of the first embodiment and hence are assigned with the same reference numerals. In this embodiment of FIG. 4, the image printing device includes a medium keeping thereon latent image charge 3 including a pyroelectric layer 1, a laser 22 and an optical system 23 collectively serving as means for selectively heating the medium 3 according to a signal, a band-shaped conductive film 25 which is brought into contact with or is disposed in the proximity of a surface of the pyroelectric layer 1 of the medium 3 and which is heated by the laser 22 to neutralize charge collected on the medium 3 due to pyroelectric effect, a developer 7 for producing a visual image with a charged toning medium according to an electrostatic latent image on the medium 3, a transfer roller 12 for transferring the developed image onto a sheet of printing paper 11, and a fixing device for fixing the transferred image onto the printing sheet 11.

Figure 5A:
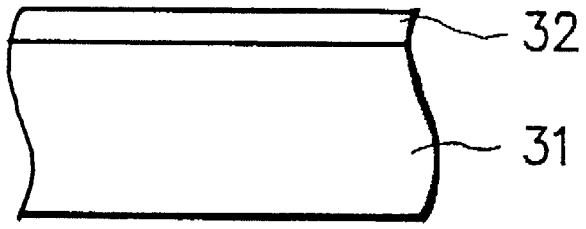
FIGS. 5A and 5B are diagrams for explaining structure of a conductive film of FIG. 4.

The surface of the pyroelectric layer 1 of the medium 3 is tightly attached onto the conductive film 25 by a platen roller 6 and a transparent supporting member 24. In this embodiment, as can be seen from FIG. 5A, the conductive film 25 is fabricated in a laminated configuration including a conductive layer 32 accumulated on a support layer 31 made of a heat-resistive polymer. Specifically, polyaramid (10 μm thick, free of carbon particles) and a highly flexible polymer containing carbon particles (5 μm thick) are employed for the support layer 31 and conductive layer 33, respectively. The conductive layer 32 is kept at a grounding potential through a conductive roller 29. According to this embodiment, during the image printing operation, the conductive film 25 is slightly moved from a roller 26 to a roller 27. This prevents deterioration in the characteristic of the film 25 due to friction between the film 25 and the medium 3.

Figure 5B:
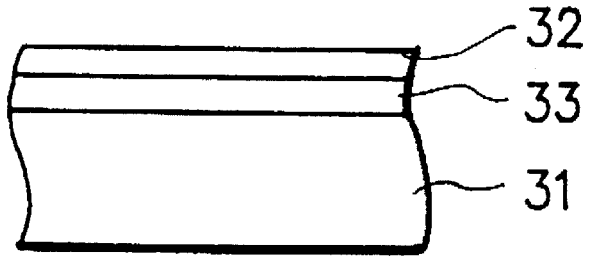

Laser light illuminated from the laser 22 under supervision of a controller 28 is irradiated onto the conductive film 25 via the optical system and support member 24. Since the support layer 31 of the film 25 is transparent with respect to the laser light, the laser light is absorbed by the conductive layer 32 to be transformed into thermal energy. Resultant heat is imparted to the medium 3 through thermal conduction to resultantly form a thermal distribution on the medium 3 according to signals. In this embodiment, the laser light is radiated directly onto the conductive layer 32 of the film 25. However, as shown in FIG. 5B, when a laser light absorbing layer 33 is additionally arranged in the conductive film 25, the heating operation can be more efficiently achieved. To effectively heat the charge keeping medium 3, the transparent support member 24 is desirably made of a material which is transparent with respect to wavelengths of laser lights and which has low thermal conductivity.

On the surface of the pyroelectric layer 1 of the medium 3 thus heated, there is collected electric charge due to pyroelectric effect. However, the surface charge is instantaneously neutralized through the conductive layer 32 of the conductive film 25 tightly fixed onto the surface of the pyroelectric layer 1. In the embodiment, the conductive layer 32 is made of a highly flexible polymer. This guarantees that the medium 3 is tightly attached onto the conductive layer 32. Consequently, the charge is neutralized with high efficiency and uniformity. Since the surface of the conductive film 25 to be brought into contact with the medium 3 is made of a material having a high flexibility, tightness or closeness of contact between the film 25 and medium 3 is increased, thereby improving efficiency and uniformity of electric neutralization. The surface material of the film 25 has desirably a gum rigidity of 60 or less. When the heated medium 3 is cooled down, a latent image 17 is created thereon with reverse-polarity charge. Thereafter, to record a desired image 19 on a sheet of printing paper 11, there may be employed such printing processes as the developing, transcribing, and fixing processes used in the first embodiment. In this connection, although the conductive film 25 is in the shape of a band in the second embodiment, it is also possible to use a film configured in an endless contour as shown in the first embodiment.

Figure 6:
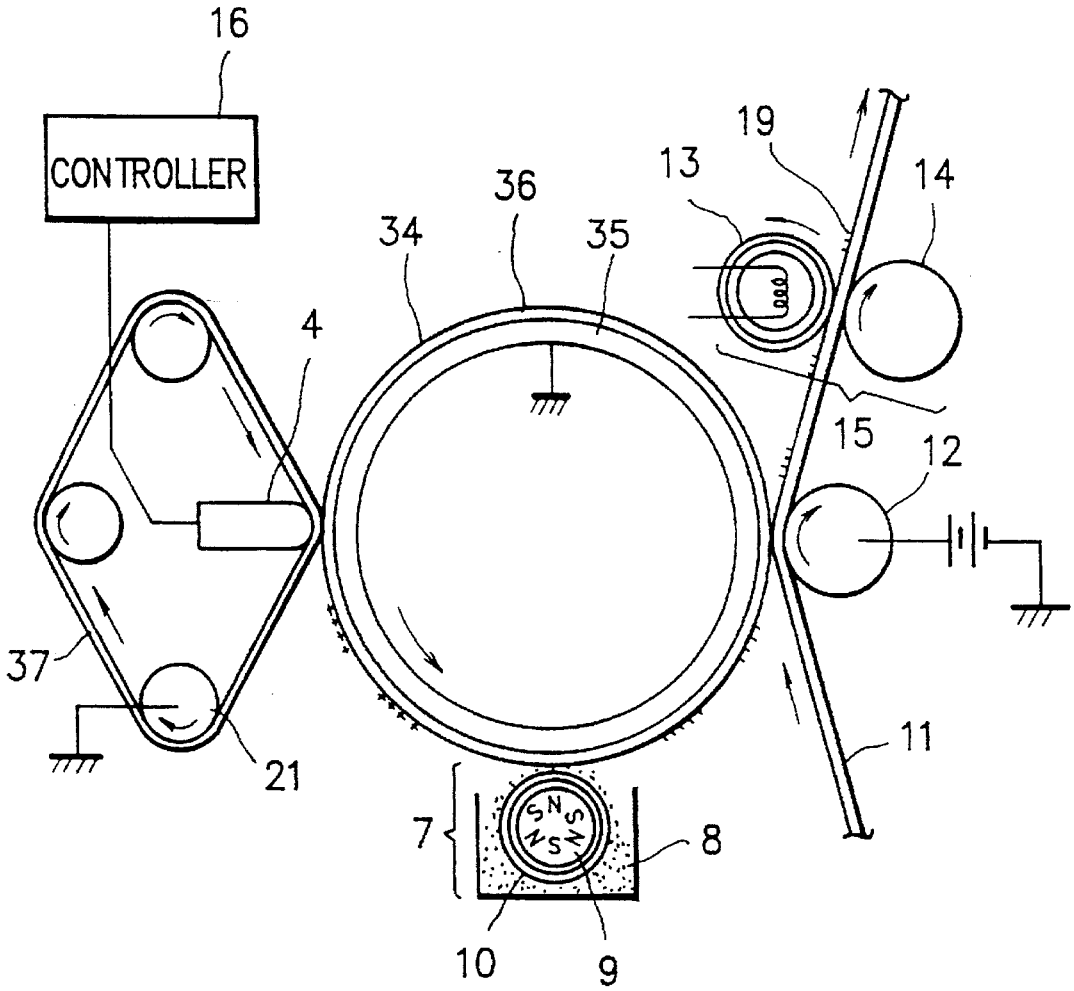
FIG. 6 is a diagram showing a third embodiment of the present invention.

FIG. 6 shows structure of a third embodiment according to the present invention in which the medium for keeping charge of a latent image is configured in a shape of a drum and a thermal head is adopted as the heating means. Excepting these elements, the other components of fundamental constitution of the apparatus are the same as those of the first embodiment and are assigned with the same reference numerals. The image printing facility of the embodiment shown in FIG. 6 includes a drum-shaped charge keeping medium 34 including a pyroelectric layer 36, a thermal head 4 for selectively heating the medium 34 according to a signal, a conductive film 37 which is configured in an endless contour and which is brought into contact with or is disposed in the neighborhood of a surface of the pyroelectric layer 36 of the medium 34 for being heated by the thermal head 4 and neutralizing charge generated on the medium 34 by pyroelectric effect, a developing device 7 for producing a visual image with a charged toning medium according to an electrostatic latent image formed on the medium 34, a transferring roller 12 for transcribing the developed image onto a sheet of printing paper 11, and a fixing device 15 for fixing the transferred image on the printing sheet 11.

Figure 7:
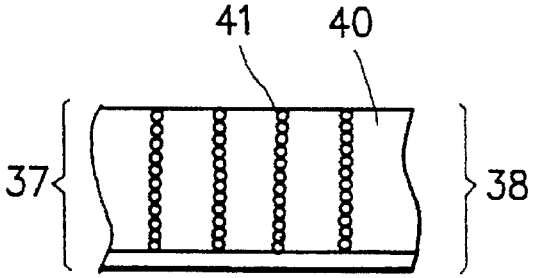
FIG. 7 is a diagram for explaining the configuration of a conductive film having thermal anisotropy.

The charge keeping medium 34 includes a conductive drum 35 (aluminum) and a pyroelectric layer 36 (about 30 μm thick PVDF) fabricated thereon. The conductive drum 35 is kept at a ground potential. The conductive film 37 of the embodiment includes, as shown in FIG. 7, a thermally anisotropic film including a thermally anisotropic conductive layer 38 and an electric conductive layer 39. The thermally anisotropic conductive layer 35 is made of a material including a resin 40 and fine particles of gold 41 diffused thereinto under a predetermined condition, each particle having a mean diameter of 7 μm. This substance has thermal conductivity and electric conductivity only in the direction of film thickness. Heat produced from the thermal head 4 is efficiently imparted via the film having the thermal anisotropy effectively to the surface of the medium 34 to resultantly form on the surface of the medium 34 a temperature distribution according to that of charge on the surface of the thermal head 4 with a high fidelity. As a result, when compared with a case using a thermally isotropic conductive film, there can be formed finer dots and hence the gradation printing characteristic can be improved by controlling the amount of heat produced by the thermal head 4. For example, when using a thermal head having a resolution of 400 dots per inch (dpi), the dot diameter can be modulated at least in a range from 30 μm to 90 μm. In this embodiment, a conductive layer 39 (about 0.1 μm thick aluminum film) is disposed in the electrically conductive film 37 as a common electrode to be grounded through the roller 21. However, it may also be possible that the common electrode is arranged on the surface of the heating means and the conductive film 37 includes only the thermally anisotropic layer 38. Moreover, the conductive film employed in the first and second embodiments may also be used as the conductive film 37 in the above embodiment.

In accordance with the embodiments above, by disposing an electrically conductive film which is brought into contact with or is arranged in the vicinity of the surface of the pyroelectric layer of the medium for keeping thereon charge of a latent image and which is heated by the heating means to neutralize charge generated on the charge keeping means due to pyroelectric effect, the surface charge can be efficiently neutralized without disposing a conductive layer directly on a surface of the heating means. This leads to improvement in resolution of heating means. Moreover, it is guaranteed there is attained an improved uniform contact between the charge keeping means and the neutralizing means with higher stability so as to achieve the image printing with higher picture quality.

Furthermore, in the process of creating a latent image on the charge keeping medium, the latent image is formed thereon, namely, the medium is heated while the conductive film is being moved relative to the heating means in the same direction as the charge keeping medium. This mitigates frictional contact between the charge keeping medium and the neutralizing means (conductive film), thereby materializing an image printing medium having high reliability and durability. Additionally, it is also guaranteed that the charge keeping medium is fixedly attached onto the conductive member, enabling the image printing operation to be carried out with higher uniformity.

The electrically conductive film has a multi-layer configuration including a thin-film layer made of a polymeric substance to which electrically conductive particles are added or an electrically conductive substance and a polymer layer supporting the thin-film layer. Consequently, the resultant electrically conductive film has improved mechanical strength and a characteristic suitable for electric charge neutralization.

Since the electrically conductive film includes a layer made of a substance having thermal anisotropy developing high thermal conductivity in the direction of film thickness, finer dots can be created while suppressing thermal conduction in the surface of the electrically conductive film. With this provision, a higher gradation printing characteristic is obtained and the gray-scale printing can be achieved with improved smoothness.

The surface of the electrically conductive film brought into contact with the charge keeping medium is made of an electrically conductive material having high flexibility, namely, a gum rigidity of 60 degrees or less. In consequence, it is possible to guarantee highly tight contact between the surfaces respectively of the charge keeping medium and electrically conductive film. As a result, the surface charge can be efficiently neutralized with higher uniformity in the latent image creating process. This leads to an advantageous effect of improving the picture fuality in the image printing operation.

Figure 8:
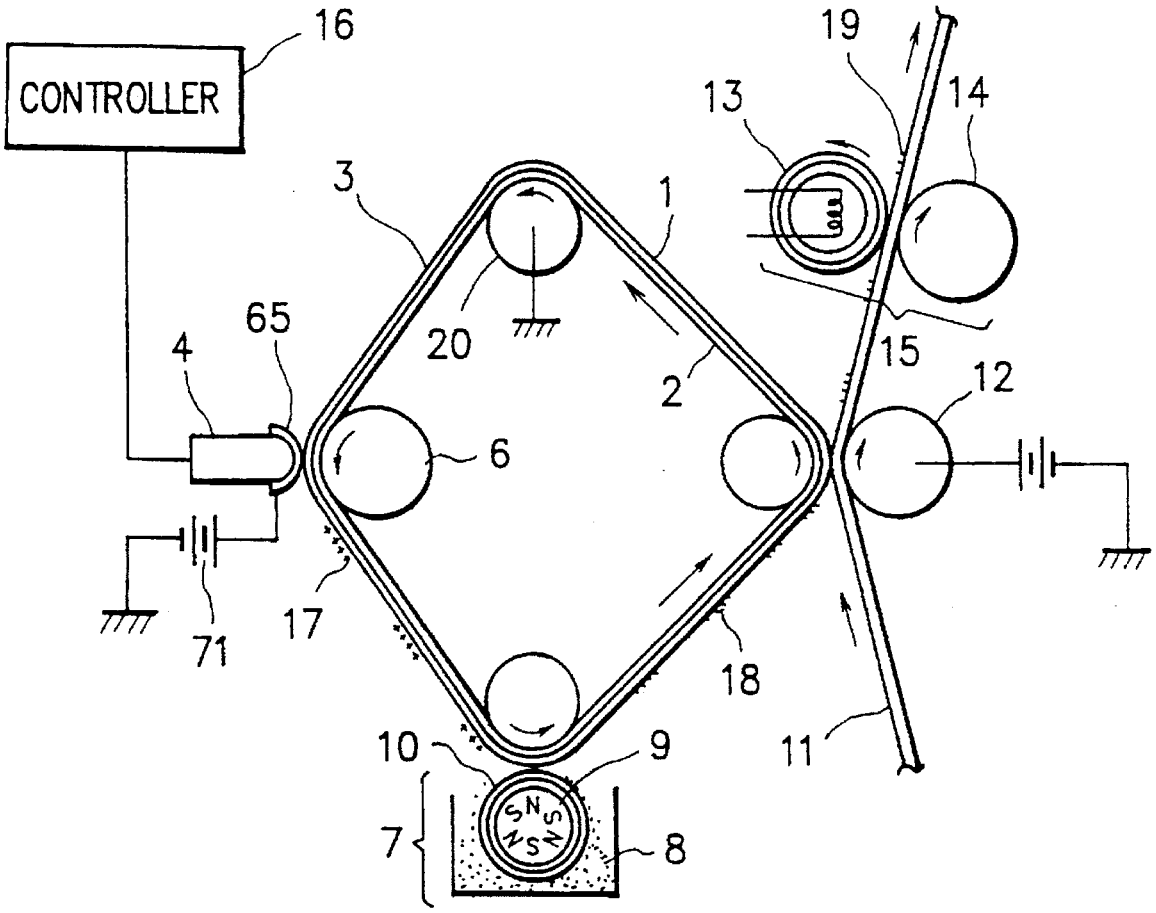
FIG. 8 is a diagram for explaining an embodiment in which a conductive layer formed on a surface of a thermal head is used as charge neutralizing means according to the present invention.

FIG. 8 shows constitution of a fourth embodiment according to the present invention in which a thermal head and an electrically conductive layer formed on a surface of the thermal head are adopted as means for heating the charge keeping medium and charge neutralizing means, respectively.

The image printing apparatus of the embodiment includes a medium 3 which is formed in an endless contour to keep thereon charge of a latent image, a thermal head 4, an electrically conductive layer 65, a power source 71, a developing facility 7 as developing means, a transfer roller 12 as image transcribing means, and a fixing device 15.

Referring now to FIGS. 9A to 9D, description will be given of the principle of the fourth embodiment.

Figure 9A:
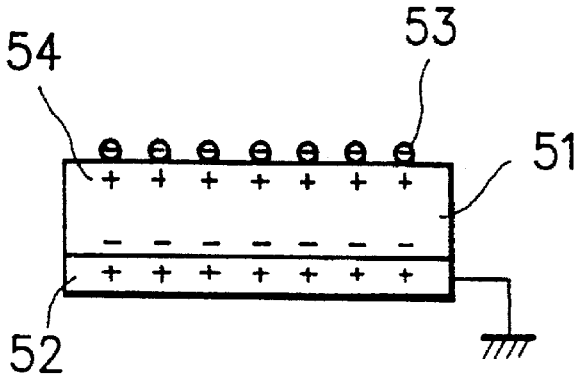
FIGS. 9A to 9D are diagrams for explaining a procedure of generating a latent image.

The medium 3 includes a pyroelectric layer 51 having polarized charge 54 on a surface thereof due to spontaneous polarization of molecules. Initially, the surface charge is in a neutralized state. That is, floating charge existing in the air or true effective charge 53 supplied from neutralizing means such as an electrically conductive brush fixes onto the surface of the pyroelectric layer 51 to resultantly form the electrically neutralized state (FIG. 9A). In the following description, it is assumed that polarized charge collected on the surface of the pyroelectric layer 51 due to spontaneous polarization of molecules of the layer 51 has the positive polarity. Initially, substantially an equal amount of charge having the negative polarity fixes onto the surface of the pyroelectric layer to establish the neutral state.

The charge keeping medium 3 is locally heated by heating means according to a signal. In the heated portion of the medium 3, the state of orientation of molecules is altered and hence the amount of polarized charge is decreased on the surface of the pyroelectric layer 51. In consequence, the negative charge fixed on the surface becomes excessive.

Figure 9B:
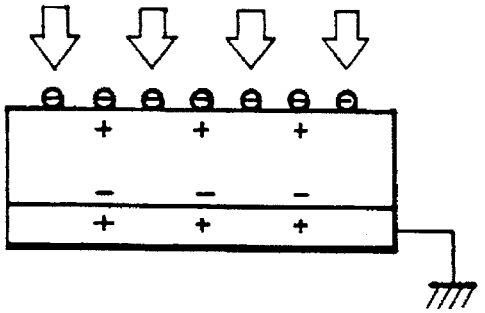
Figure 9C:
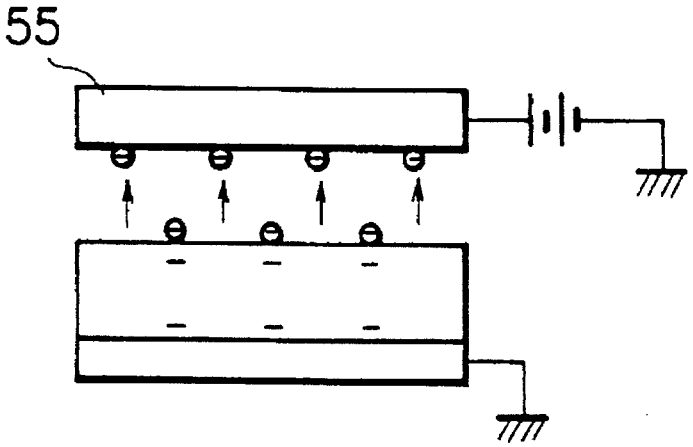

Resultantly, the surface of the pyroelectric layer is negatively charged (FIG. 9B). In this regard, although the conductive layer 52 is kept retained at a ground potential for the following reasons. Namely, the true effective charge 53 fixed onto the surface of the pyroelectric layer 51 is kept remained in a stable state and the potential of the latent image is stabilized in the subsequent image developing and transferring processes.

Charge neutralizing means 55 is disposed to be brought into contact with or to be in the proximity of the pyroelectric layer surface such that the excessive charge appearing on the surface is neutralized by the neutralizing means 55 and hence the surface is gradually returned to the neutral state (FIG. 90. In this situation, a bias voltage is applied to the charge neutralizing means 55 so that an absorbing or repulsive force acts upon the excessive charge on the pyroelectric layer surface. Intensity of the bias voltage is set to an appropriate value according to the condition of generating the latent image (i.e. of heating the pyroelectric layer). For example, in case where the satisfactory contact cannot be guaranteed between the charge neutralizing means and the pyroelectric layer surface, a bias voltage having a polarity opposite to that of the excessive charge is applied to the neutralizing means 55. This causes a strong absorbing force to exert influence upon the excessive charge and hence the excessive charge is efficiently cancelled on the surface. Conversely, when the amount of heat is excessive due to accumulated heat of the heating means, a bias voltage having the same polarity as the excessive charge is applied to the neutralizing means. As a result, the amount of charge to be neutralized is reduced and hence it is possible to suppress the unnecessary increase in the printing density.

Figure 9D:
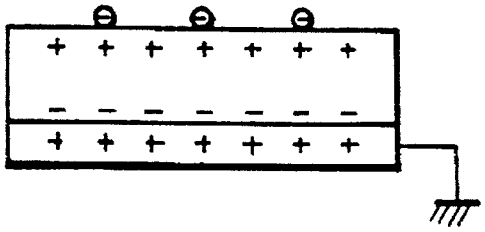

After the heating stage is finished, when the charge keeping medium is cooled down to the initial temperature, the polarized state is also restored to the original state in the pyroelectric layer. In this situation, since the pyroelectric layer surface has already been separated from the charge neutralizing means, the negative charge is insufficient on the pyroelectric layer surface. Virtually, the surface is positively charged (FIG. 9D). That is, after the charge keeping medium is cooled, a positive-polarity latent image is formed in the heated portion thereof. As above, the latent image of charge has a polarity opposite to that of (excessive) charge appearing in the heating process and hence is called "latent image by opposite-polarity charge" in this specification.

The latent image is gradually vanished because floating charge existing in the air is collected onto the image. However, the phenomenon generally takes a long period of time, namely, the latent image is kept retained for several hours to several tens of hours.

When the charge keeping medium on which the latent image is formed is in the vicinity of or is brought into contact with the charged toning or coloring medium, particles of the charged toning medium are selectively fixed onto the pyroelectric layer surface so as to visualize (develop) the latent image. The toner particles fixed onto the charge keeping medium are then transferred and fixed onto the printing medium, thereby creating a desired image thereon.

On the surface of the thermal head 4, an electrically conductive layer 65 is formed as the charge neutralizing means to cover the heating section. In this embodiment, a thin metallic film of aluminum or chrome having a thickness of about 1000 angstroms is fabricated on the thermal head surface by evaporation. The film is used as the electrically conductive layer 65. In addition to the thin metallic film adopted in the embodiment, other substances including electrically conductive organic materials may be utilized. Moreover, there may be employed a laminated configuration in which an insulating layer is fabricated as the base of the electrically conductive layer.

On the surface of the pyroelectric layer 1 of the heated medium 3, electric charge appears due to pyroelectric effect to be then neutralized through the conductive layer 65. According to the embodiment, a bias voltage of +300 V is applied from a power supply 71 to the conductive layer 65 so that a strong absorbing force acts upon the generated charge (having the negative polarity). In consequence, the surface charge of the pyroelectric layer 1 is removed in a short period of time. Furthermore, the surface charge is fully cancelled even when the conductive layer 65 is not completely brought into contact with the surface of the pyroelectric layer 1.

According to printing experiments conducted in the configuration of the image printing device above, it is possible to record images having sufficient printing density (OD value of about 1.6) and high uniformity in density on a sheet of ordinary printing paper having a relatively rough surface.

In accordance with the embodiment, the excessive charge can be optimally neutralized in the process of creating a latent image. Particularly, when a bias voltage of the polarity reverse to that of excessive charge is applied to the electrically conductive layer, the neutralizing efficiency is remarkably improved. Consequently, the image can be recorded with high printing density also in a high-speed printing operation. Furthermore, even when the contact between the charge neutralizing means and the surface of the pyroelectric layer is insufficient, the surface charge can be fully neutralized. Consequently, the image can be recorded with satisfactory uniformity in printing density.

Figure 10:
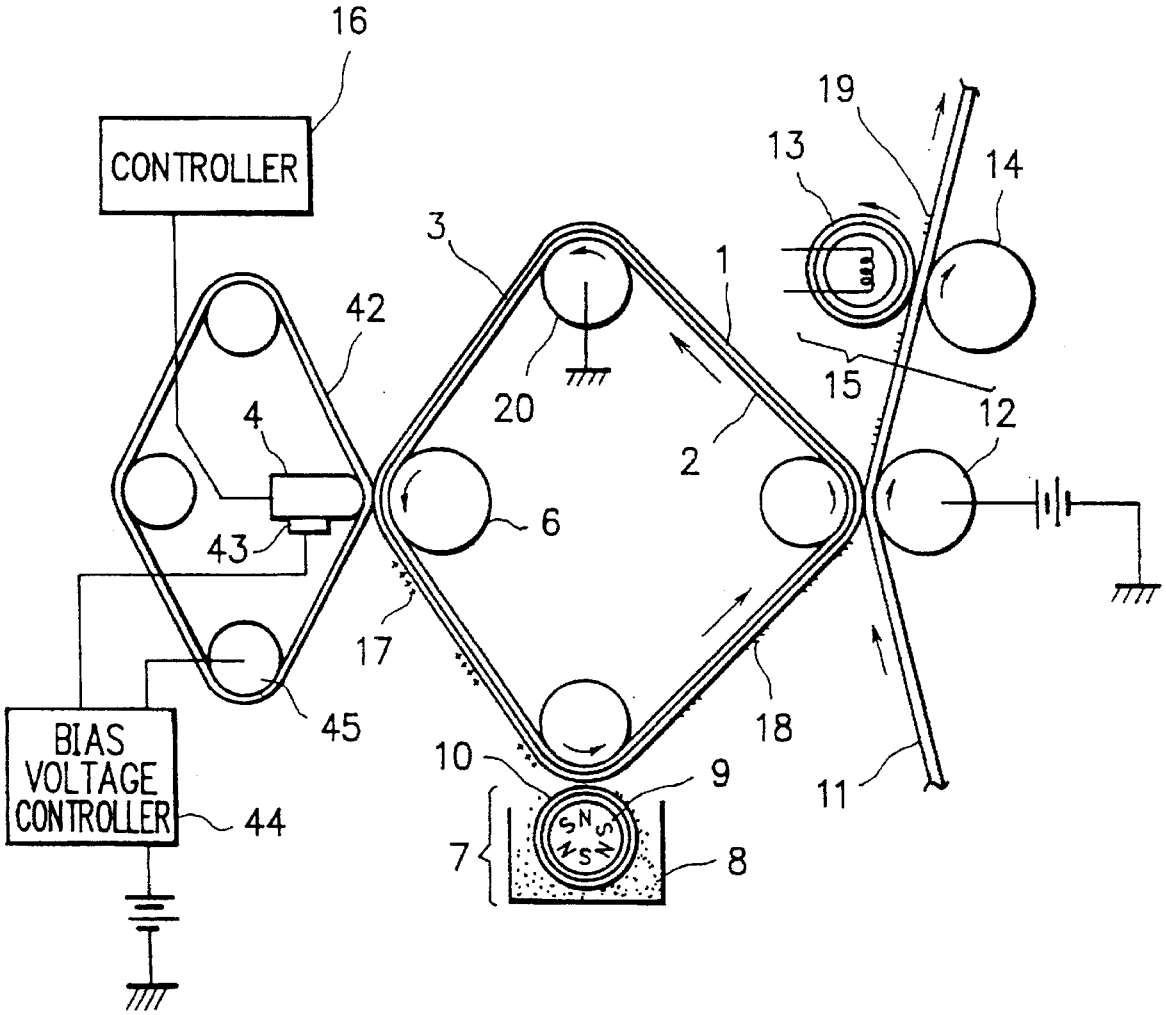
FIG. 10 is a diagram for explaining an embodiment in which a conductive film is adopted as the charge neutralizing means according to the present invention.

FIG. 10 shows structure of a fifth embodiment in accordance with the present invention including a thermal head as means of heating the charge keeping medium and an electrically conductive film as charge neutralizing means. The constituent components other than the charge neutralizing means are the same as those of the embodiment shown in FIG. 8 and are assigned with the same reference numerals.

The image printing apparatus of the embodiment includes a latent image charge keeping medium 3 in the form of an endless contour, a thermal head 4, an electrically conductive film 42, a temperature sensor 43, a bias voltage controller 44, a developer 7 as image developing means, a transfer roller 12 as image transcribing means, and a fixing device 15.

The charge keeping medium 3 is fixedly attached onto the conductive film 42 by the thermal head 4 and a platen roller 6. The medium 3 is heated through the conductive film 42. In this embodiment, the film 42 is made of a heat resistive polymer, polyaramid (about 15 μm thick). Carbon particles are slightly added to the material to develop conductivity equivalent to $10^3$ to $10^4$ ohm. The film is configured in the form of an endless belt. The latent image is produced while moving the belt 42 and the medium 3 at the same speed in the same direction.

On the surface of the pyroelectric layer 1 of the heated medium 3, there is collected electric charge due to pyroelectric effect. The surface charge is thereafter neutralized through the conductive film 42. A bias voltage is applied via a roller 45 to the conductive film 42. In this embodiment, the representative temperature of the thermal head 4 is measured by the temperature sensor 43 disposed thereon. Based on the obtained temperature data, the bias voltage to be applied to the conductive film 42 is regulated by the bias voltage controller 44. That is, when the temperature of the thermal head 4 is increasing due to accumulation of heat, the bias voltage applied to the conductive film 42 is reduced (or a bias voltage having the opposite polarity is applied thereto) to minimize the charge neutralizing efficiency, thereby suppressing any excessive increase in printing density.

When the heated medium 3 is cooled down, a latent image 17 is formed by the reverse-polarity charge. A desired image 19 can be recorded on a sheet of printing paper 11 by the image printing processes including the image developing, transferring, and fixing processes shown in FIG. 8.

In the embodiment, as the method of compensating for heat accumulation in the heating means, the printing density is adjusted by the bias voltage. However, the effect of density adjustment by the bias voltage may also be used in other configurations. For example, it may be possible that the operator of the image printing apparatus arbitrarily adjusts the bias voltage to simply regulate image printing density.

In accordance with the embodiment, even when the mean value of temperature of the heating means is altered in association with heat accumulation or due to variation in the environmental temperature, the charge density can be kept unchanged in the resultant latent image. Consequently, there can be provided a highly reliable image printing facility capable of producing an image with high picture quality.

Figure 11:
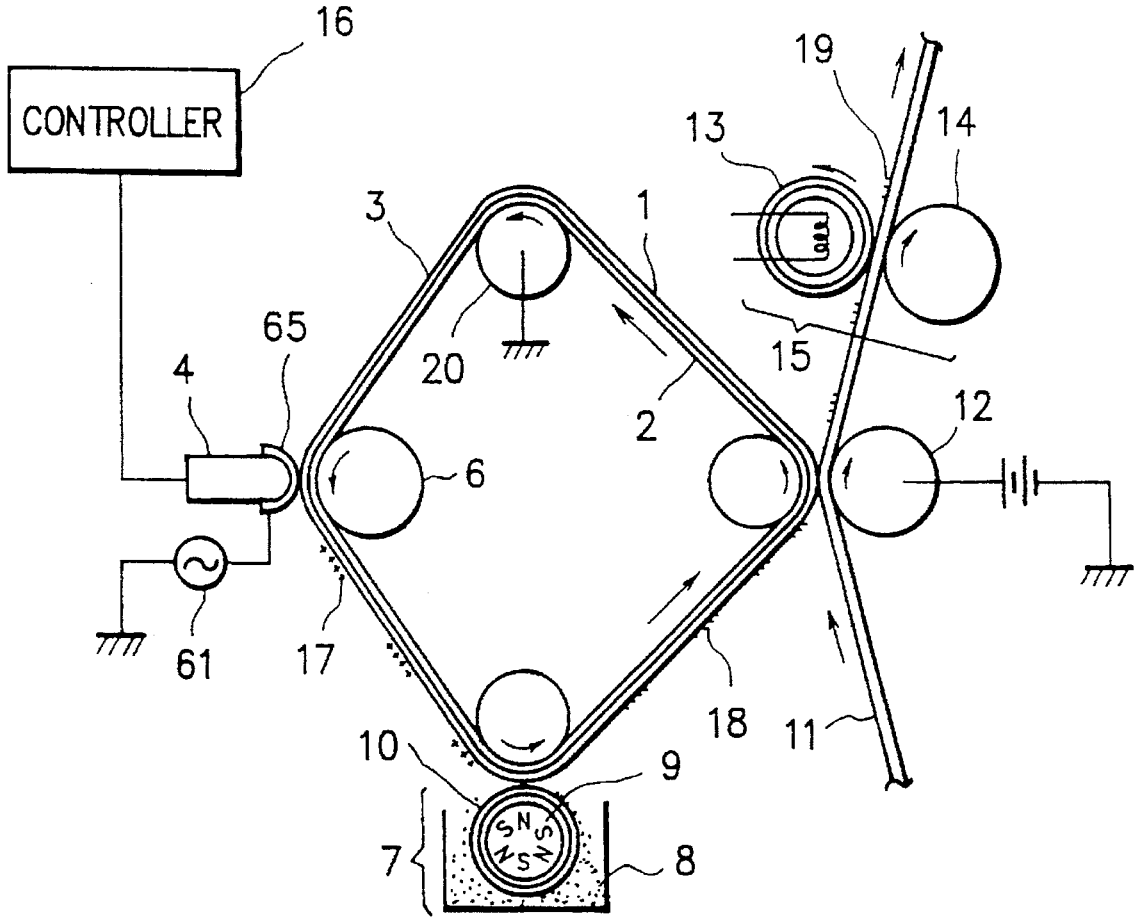
FIG. 11 is a diagram for explaining an embodiment in which a conductive layer formed on a surface of a thermal head is used as charge neutralizing means according to the present invention.

FIG. 11 shows a sixth embodiment in accordance with the present invention. The image printing device of the embodiment includes a charge keeping medium 3 in the form of an endless belt, a thermal head 4 as heating means, an electrically conductive layer 65 as charge neutralizing means, a power source 61, a developing device 7, an image transfer roller 12, and a fixing device 15.

Referring now to FIGS. 14A to 14D, description will be given of the principle of the embodiment.

Figure 14A:
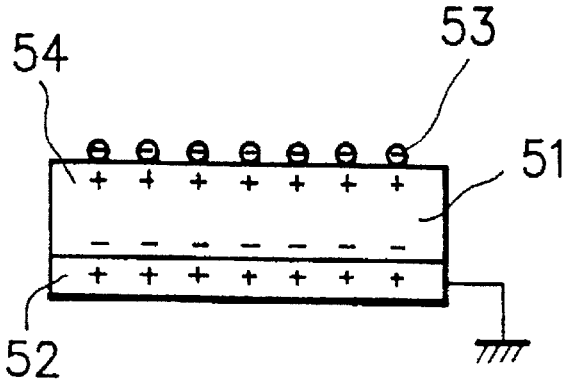
FIGS. 14A to 14D are diagrams for explaining a process of generating a latent image.

The medium 3 includes a pyroelectric layer 51 on which polarized charge 54 is collected due to spontaneous polarization of molecules thereof. Initially, the surface charge is in the neutralized state. Namely, floating charge in the air or true effective charge from neutralizing means such as an electrically conductive brush fixes onto the pyroelectric layer surface to form an electrically neutral state (FIG. 14A). In the following description, it is assumed that the polarized charge appearing the pyroelectric layer surface due to spontaneous polarization of the pyroelectric substance has the positive polarity and the same amount of true effective charge having the negative polarity fixes onto the pyroelectric layer surface to resultantly form an electrically neutral state.

Figure 14B:
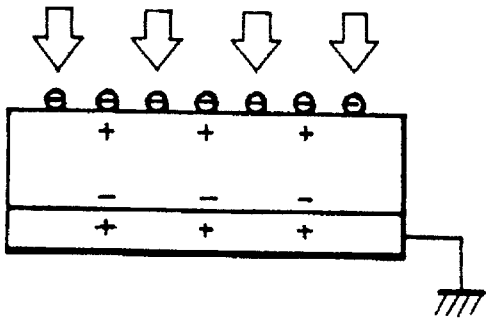

The charge keeping medium 3 is locally heated by the heating means 4 according to signals. In the heated portion of the medium 3, the state of orientation of molecules is changed in the pyroelectric material to minimize the amount of polarized charge on the surface of the pyroelectric layer. Consequently, the amount of opposite-polarity charge becomes excessive on the pyroelectric layer surface. As a result, the surface is negatively charged (FIG. 14B).

Figure 14C:
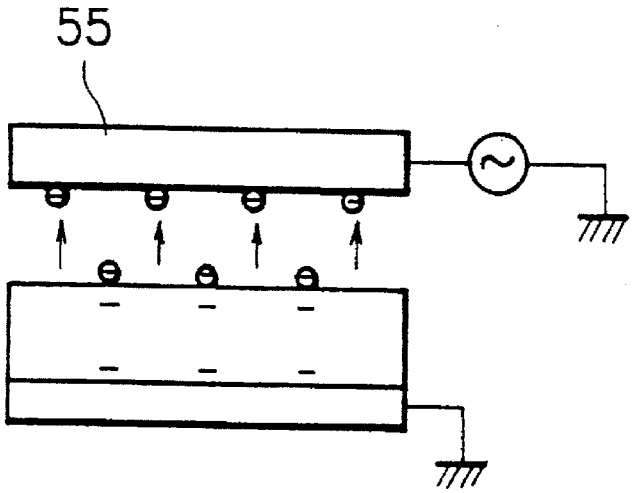

The pyroelectric layer surface is brought into contact with or is in the neighborhood of a charge neutralizing means 55. Excessive charge generated on the surface is cancelled by the neutralizing means 55 and hence the surface becomes an electrically neutral state again (FIG. 14C). In this operation, the neutralizing means 55 is applied with an alternating-current (ac) voltage in which the voltage value periodically varies centered on a reference voltage of 0 volt. Thanks to the ac voltage applied thereto, an oscillating electric field having a periodically changing electric field intensity is created between the charge keeping medium 3 and the charge neutralizing means 65, thereby uniformly neutralizing the charge keeping medium 3. Namely, the shift of charge from the surface of the charge keeping medium e to the neutralizing means 65 and that of charge from the neutralizing means 65 to the surface of the charge keeping medium 3 are repeatedly accomplished with a short cycle so as to accordingly generate a uniformly neutralized state on the surface of the charge keeping medium 3.

Figure 14D:
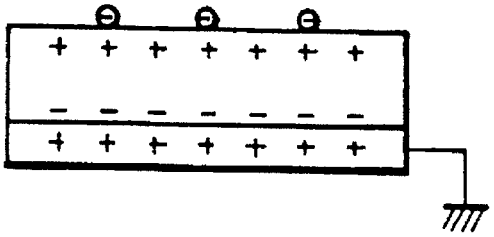

After the heating step is completed, when the charge keeping medium 3 is cooled down to the initial temperature, the polarized state of molecules is also restored in the pyroelectric layer. In this situation, since the pyroelectric layer surface is separated from the charge neutralizing means 65, the negative-polarity charge becomes insufficient on the pyroelectric layer surface. Consequently, the surface is virtually charged with positive-polarity charge (FIG. 14D). That is, in the heated portion of the charge keeping medium 3, there is formed a positive-polarity latent image when the medium 3 is cooled down. The latent image thus created is gradually vanished because floating charge in the air fixes on to the surface. However, the phenomenon generally takes a long period of time and hence the latent image is kept thereon for several hours to several tens of hours in ordinary cases.

The latent image on the charge keeping medium 3 is visualized or developed with a charged toning medium and is then transferred and fixed on a printing medium such as a sheet of printing paper when necessary, thereby attained a desired image.

Furthermore, the reference potential of the charge neutralizing operation can be altered by superimposing a direct-current (dc) voltage component onto the ac voltage applied to the neutralizing means. Namely, even when the heating temperature is fixed, the latent image potential can be varied by altering the dc voltage component in the voltage applied to the neutralizing means. Consequently, in case where the latent image potential is changed due to factors such as variation in the environmental temperature and increase in temperature of the heating means, the latent image potential can be kept unchanged by adjusting the magnitude of the dc voltage component.

The charge keeping medium 3 is formed as a film including a pyroelectric layer 1 (about 100 μm thick) and an electrically conductive layer 2 (about 0.1 μm thick), the film being configured in the form of an endless-belt contour. The pyroelectric layer 1 and conductive layer 2 are made of PVDF and aluminum, respectively. The conductive layer 2 is kept at the ground potential via an electrically conductive roller 20.

Formed on a surface of the thermal head 4 is an electrically conductive layer 65 as charge neutralizing means, the layer 65 covering the heating section. In this embodiment, a thin metallic film having a thickness of about 0.1 μm of aluminum or chrome is arranged on the thermal head surface by evaporation. This film is adopted as the conductive layer. As the conductive layer on the thermal head surface, there may be utilized such materials other than the metallic film of the embodiment as an electrically conductive organic substance. An insulating layer may be manufactured as the base of the electrically conductive layer to resultantly form a laminated construction.

On the surface of the pyroelectric layer 1 of the charge keeping medium 3 thus heated, there is gathered electric charge (excessive charge) due to pyroelectric effect. The charge is neutralized through the conductive layer 65. In this configuration, the layer 65 is applied with an ac voltage from a power supply 61. The ac voltage in this specification indicates a voltage of which the value periodically alters centered on a reference voltage of 0 volt. In the embodiment, the conductive layer 65 is applied with an ac voltage of which the voltage varies in the form of a sine wave with an amplitude of 1.5 kV and frequency of 100 herz (Hz). As a result, transfer of electric charge is enhanced between the surface of the pyroelectric layer 1 of the charge keeping medium 3 and the conductive layer 65 and hence the surface charge is uniformly neutralized at a high speed.

In the configuration of the image printing device of the embodiment, the frequency and amplitude of the ac voltage are desirably set to 50 to 500 Hz and 1 kV or more, respectively. However, the optimal frequency and amplitude depend on materials and surface contours respectively of the neutralizing means and charge keeping medium and hence are not necessarily limited to the ranges of values described above. Moreover, to obtain the similar advantageous effect, there may be utilized, in addition to the waveform similar to that of the sine wave, a triangle waveform, a rectangular waveform and all other waveform as the waveform of the ac voltage to be applied to the charge neutralizing means.

In accordance with the present invention, after the heating step is finished, the heated medium is naturally cooled down to the room temperature to produce a latent image with the opposite-polarity charge. Specifically, when the increase in temperature of the surface of the pyroelectric layer 1 is 40° C., there is attained a latent image potential of about 900 V.

The latent image 17 on the medium 3 is developed by the developer 7 using the two-component magnetic brushing operation. Namely, there is employed a developing agent 8 containing insulating and non-magnetic toner particles mixed with magnetic carrier particles so as to electrically charge the toner particles by friction therebetween. The agent 8 in which toner particles are fixed onto carrier particle surfaces are kept applied to a sleeve 10 with a magnet roller 9 disposed therein. When the agent 8 is brought into contact with the charge keeping medium 3, the toner particles are selectively fixed onto the surface of the medium according to the charge distribution thereon, thereby forming a visual image.

After the developing process, the medium 3 is fixed with a sheet of printing paper 11 as a printing medium. The transfer roller 12 then pushes a rear surface of the printing sheet 11 to electrostatically transfer toner particles onto the surface of the printing sheet 11. In the embodiment, a voltage of about +1 kV is applied to the conductive gum roller to achieve the electrostatic transfer of tone particles.

The printing sheet 11 carrying toner particles thereon is passed through the fixing facility 15 including a heat roller 13 and a pressure roller 14 such that the toner particles are once fused on the sheet surface, thereby fixing the toner on the printing sheet 11.

The method of developing the latent image, kind of the developing agent, method of transferring toner particles onto the printing medium, and method of fixing the toner onto the printing medium are not restricted by those used in the embodiment. Namely, the similar advantageous effect can be attained according to other methods and developing agents conventionally utilized in electrophotography.

After the toner is transferred onto the printing sheet 11, the charge keeping medium 3 is again moved to the latent image creating section (thermal head section) to produce a subsequent latent image. Prior thereto, when toner particles not transferred exist on the medium 3, the remaining toner particles are removed by a cleaner (not shown) when necessary. Furthermore, when there remains a portion of the latent image charge, charge removing means (not shown) such as an electrically conductive brush grounded is brought into contact with the surface of the pyroelectric layer 1 as necessary to neutralize the charge remaining on the pyroelectric layer surface. In this connection, when few toner particles and little latent image charge are remaining after transfer of toner particles, the cleaner and charge removing means are not necessarily utilized.

According to results of printing experiments conducted in the configuration of the image printing device above, it has been confirmed that a high-density gray-scale printing is achieved on a sheet of ordinary printing paper having a relatively rough surface with a maximum density of about 1.6 in terms of the OD value and with a highly uniform density (fluctuation in OD values is ±0.05).

For comparison, there have been conducted printing experiments in a state in which the charge neutralizing means (conductive layer 65) is not applied with the ac voltage and the layer 65 is grounded. Resultantly, the fluctuation in the OD values in the grapy-scale printing is remarkable deteriorated to ±0.6 on average. Moreover, the OD value of the maximum printing density becomes about 1.4, which is deteriorated as compared with the associated value developed when the ac voltage is applied to the layer 65.

Moreover, for comparison, there have been effected printing experiments in which only a dc current (+100 to +300 V) is applied to the charge neutralizing means (conductive layer 65). As a result, the maximum printing density is attained as about 1.6 in terms of the OD value, which is comparable with that obtained when the ac voltage is also applied thereto. However, the fluctuation in the OD values in the grapy-scale printing is deteriorated to ±0.5 on average. That is, the dc voltage applied to the charge neutralizing means is effective to improve efficiency of charge neutralization but is not particularly effective to homegenize charge neutralization.

In accordance with an aspect of the present invention in which an ac voltage is applied to the charge neutralizing means, as can be understood from the above experiments, it is possible to improve efficiency and uniformity of charge neutralization at the same time, which leads to improvement of picture quality in the image printing.

Figure 12:
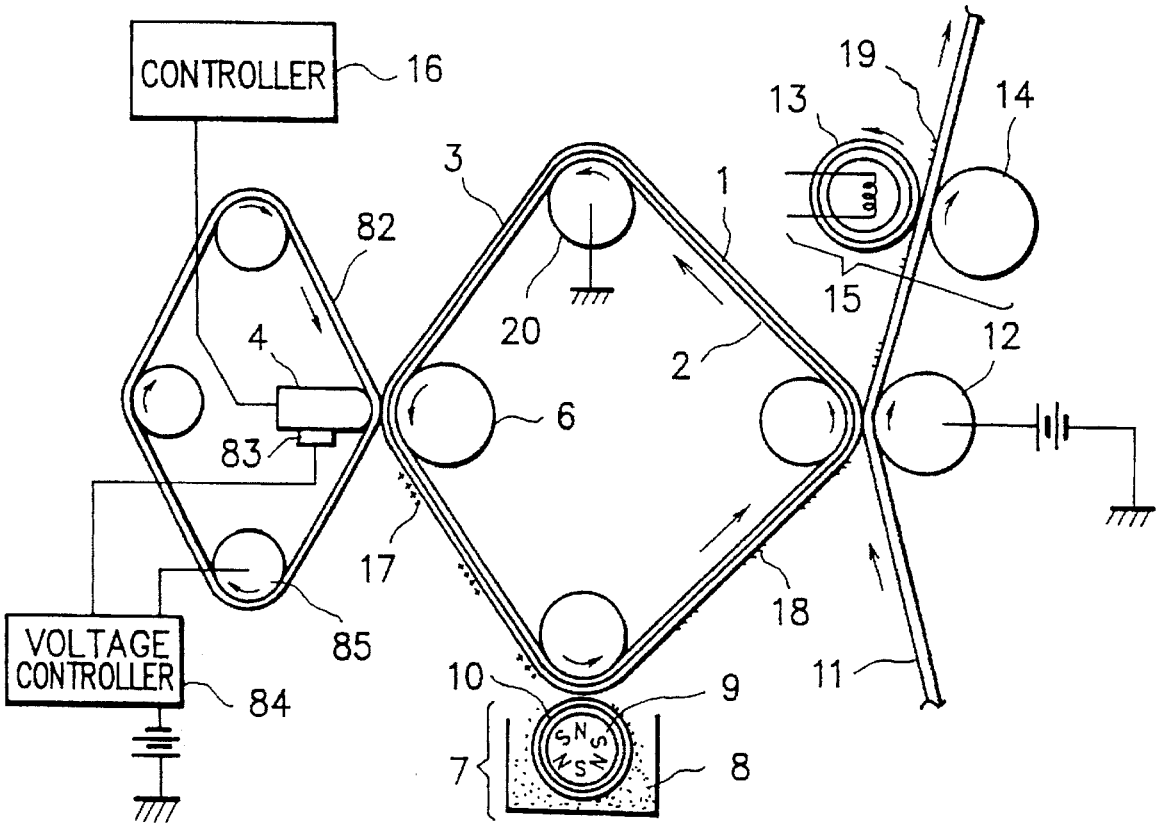
FIG. 12 is a diagram for explaining an embodiment in which a conductive film is utilized as charge neutralizing means according to the present invention.
Figure 13:
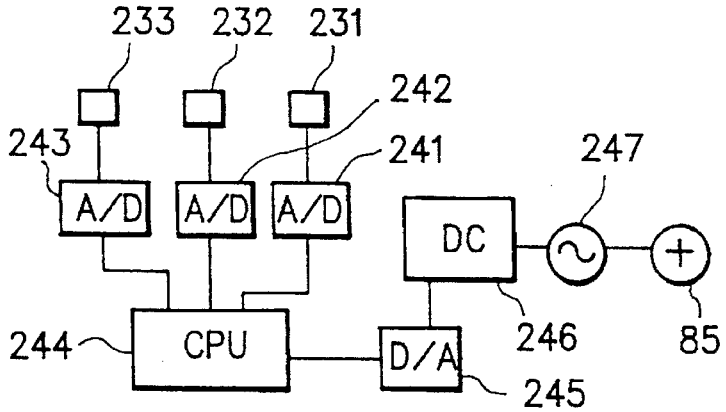
FIG. 13 is a diagram showing structure of a voltage controller of FIG. 12.

FIG. 12 shows a seventh embodiment in accordance with the present invention. Excepting that an electrically conductive film is adopted as the charge neutralizing means, the constituent components are substantially the same as those of the sixth embodiment and are assigned with the same reference numerals. The image printing device of the embodiment includes a latent image charge keeping medium 3 in the form of an endless belt, a thermal head 4 as heating means, an electrically conductive layer 82, a temperature sensor 83, a voltage controller 84, an image developing device 7, a transfer roller 12, and a fixing device 15.

The medium 3 is closely attached onto the conductive film 82 by the thermal head 4 and platen roller 6 and is heated via the film 82. In this embodiment, the conductive film 82 is about 15 μm thick and is made of polyaramid, which is a heat resistive polymeric material. Carbon particles are slightly added to the material to attain conductivity of $10^3$ to $10^4$ ohm. The film is configured in the form of an endless belt. The conductive film 82 and the medium 3 are transported at the same speed in the same direction to produce a latent image on the medium 3.

On the surface of the pyroelectric layer 1 thus heated, electric charge is collected due to pyroelectric effect. The charge is neutralized through the conductive film 82. The film 82 is applied via roller 85 with a pulsated voltage in which an ac voltage component is superimposed onto a dc voltage component. In the embodiment, the ac voltage component has an amplitude of 1.5 kV and a frequency of 100 Hz and the dc voltage component has a voltage value varied in a range from −200 V to +200 V by the voltage controller 84 according to the base temperature of the thermal head 4 measured by the temperature sensor 83. With the control operation, the potential of the obtained latent image is kept retained at a fixed voltage.

FIG. 18 shows in a block diagram the configuration of the voltage controller 84. As can be seen from the diagram, the sensor 83 includes a sensor 231 for sensing the base temperature of the thermal head 4 and sensors 232 and 233 for respectively measuring temperature and humidity in the apparatus. According to information of temperature and humidity sensed by the sensors 231 to 283, there are generated control signals to be delivered respectively to analog-to-digital (A/D) convertors 241 to 243. The resultant digital signals are fed to a central processing unit (CPU) 244. In response to the received control signals, the CPU 244 produces a signal to regulate a dc component and then sends the signal to a digital-to-analog (D/A) convertor 245. The obtained analog signal is transmitted to a dc power source 246, which in turn produces a dc voltage having a controlled value. The dc voltage is added to an ac voltage generated from an ac power source 247 such that the obtained voltage is sent to the roller 85.

For example, in case where the temperature of the thermal head 4 is generally increased by 10° C. through heat accumulation, the surface potential of the pyroelectric layer 1 is generally shifted due to the applied heat (equivalent to 10° C. increase in the temperature of the thermal head 4; about 220 V in this embodiment) when the dc voltage component is not superimposed onto the ac voltage component. In consequence, there arise a problem of an undesirable increase in image printing density and a problem in which toner particles fix onto portions other than the image on the printing sheet (resulting in a foggy picture). To cope with the problems, the dc-voltage component of the pulsated voltage applied to the charge neutralizing means is set to a polarity opposite to that of the latent image and the magnitude of the dc voltage component is regulated to cancel the increased portion of the surface potential due to accumulated heat, thereby preventing the shift of surface potential above. This enables the latent image potential to be kept retained in any cases.

After the heating process, when the medium 3 is cooled down, there is formed a latent image 17 with opposite-polarity charge. To appropriately produce the image 19 on the printing sheet 11, there may be used thereafter the printing processes similar to the developing, transferring, and fixing processes employed in the first embodiment.

According to image printing experiments conducted in the system configuration above, it has been confirmed that even when the temperature of the thermal head 4 is increased by 8° C. due to heat accumulation in a continuous ten-sheet printing operation, the density of recorded images is kept unchanged and the toner particles are rarely fixed onto portions other than the image, thereby achieving the image printing operation with high picture quality.

For comparison, similar continuous printing experiments have been carried out without controlling the dc voltage component. Resultantly, the image density is increased as heat is accumulated in the thermal head 4 and hence there appears a density difference of 0.3 in terms of the OD value between the first image and tenth image. Moreover, the amount of toner particles fixed onto portions other than the image is increased, namely, in the non-image portions of the tenth printing sheet, there has occurred a foggy portion having an OD value of about 0.4 (the value is about 0.2 for the printing sheet).

As can be seen from the comparison between the experiment results, in accordance with an aspect of the present invention in which the dc voltage component applied to the charge neutralizing means is regulated according to the base temperature of the heating means, the printing operation can be achieved with a fixed printing density even when the base temperature of the heating means is altered. This leads to a homogenous density in the image printing and makes it possible to conduct the continuous printing in a stable state.

In this connection, as the method of compensating for heat accumulation of the heating means in the embodiment, there is controlled the dc voltage component. However, the control method may also be utilized to compensate for temperature in the apparatus. Moreover, humidity in the apparatus also exercises adverse influence upon the charging and transferring characteristics of toner particles. To remove the above influence, it is effective to control the dc voltage component according to the sensed humidity in the apparatus. Furthermore, when the operator of the apparatus is allowed to arbitrarily regulate magnitude of the dc voltage component, the density of recorded images can be simply adjusted by the operator.

In accordance with the embodiment, thanks to application of an ac voltage or pulsated voltage to the charge neutralizing means, uniformity of charge neutralization is remarkably improved in the latent image creation. As a result, it is possible to improve uniformity in image density. Particularly, when reproducing an image portion having intermediate gradation levels in the gray-scale printing, there can be attained a favorably homogenous image density. Furthermore, due to improvement in charge neutralizing efficiency, the printing density can be increased also in a high-speed printing operation.

Moreover, in accordance with the present invention, the reference potential of the latent image can be controlled by regulating magnitude of the dc voltage component of the pulsated voltage applied to the charge neutralizing means. This facilitates highly accurate compensation for the change in image density due to variation in the environmental temperature and heat accumulation in the heating means.

Figure 15:
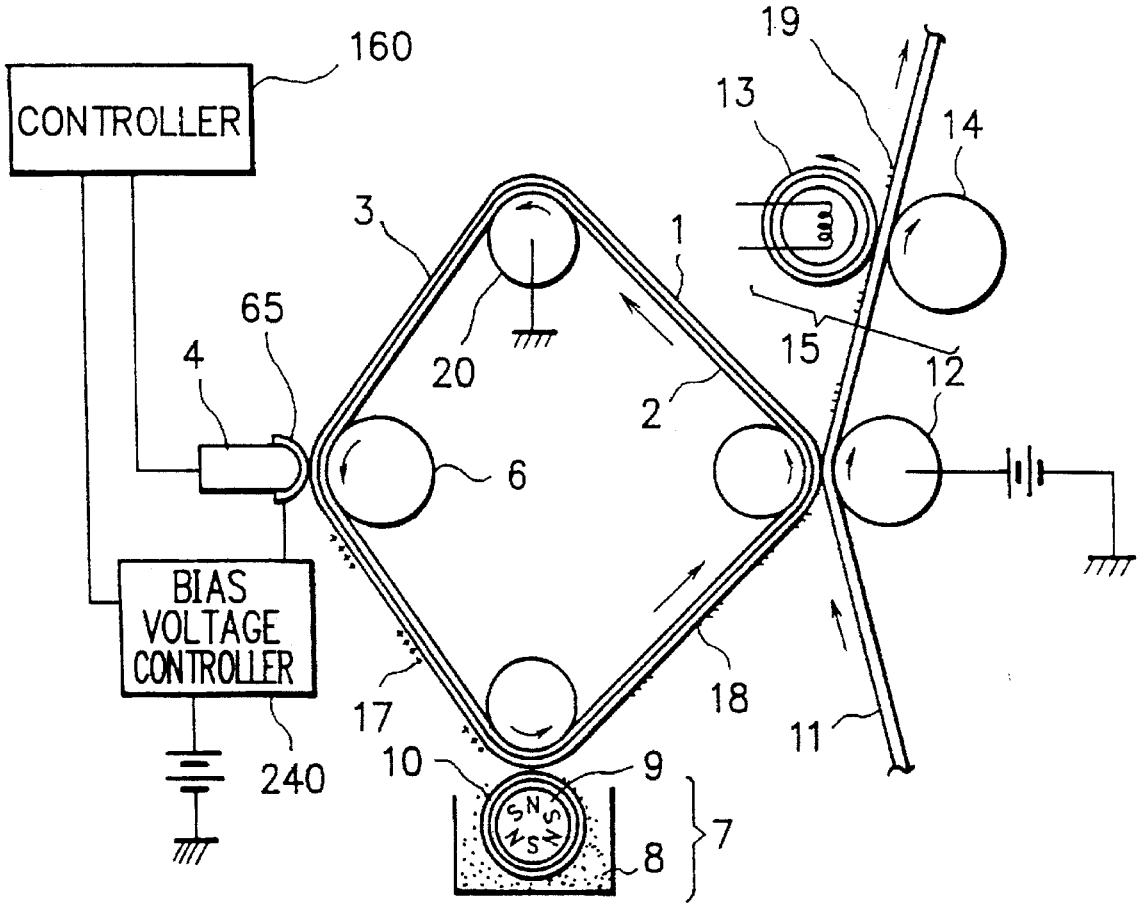
FIG. 15 is a diagram for explaining an embodiment in which the gray-scale printing is conducted by controlling heat generated from heating means and a bias voltage of charge neutralizing means.

FIG. 15 shows in a block diagram an alternative embodiment of the image printing device in which printing pixel density is modulated by controlling the amount of heat produced from the heating means and the bias voltage of the charge neutralizing means.

Excepting that the bias voltage applied to the neutralizing means is altered in association with the controller of the heating means, the configuration of constituent elements of the apparatus are the same as those of FIG. 8 and assigned with the same reference numerals.

Figure 16:
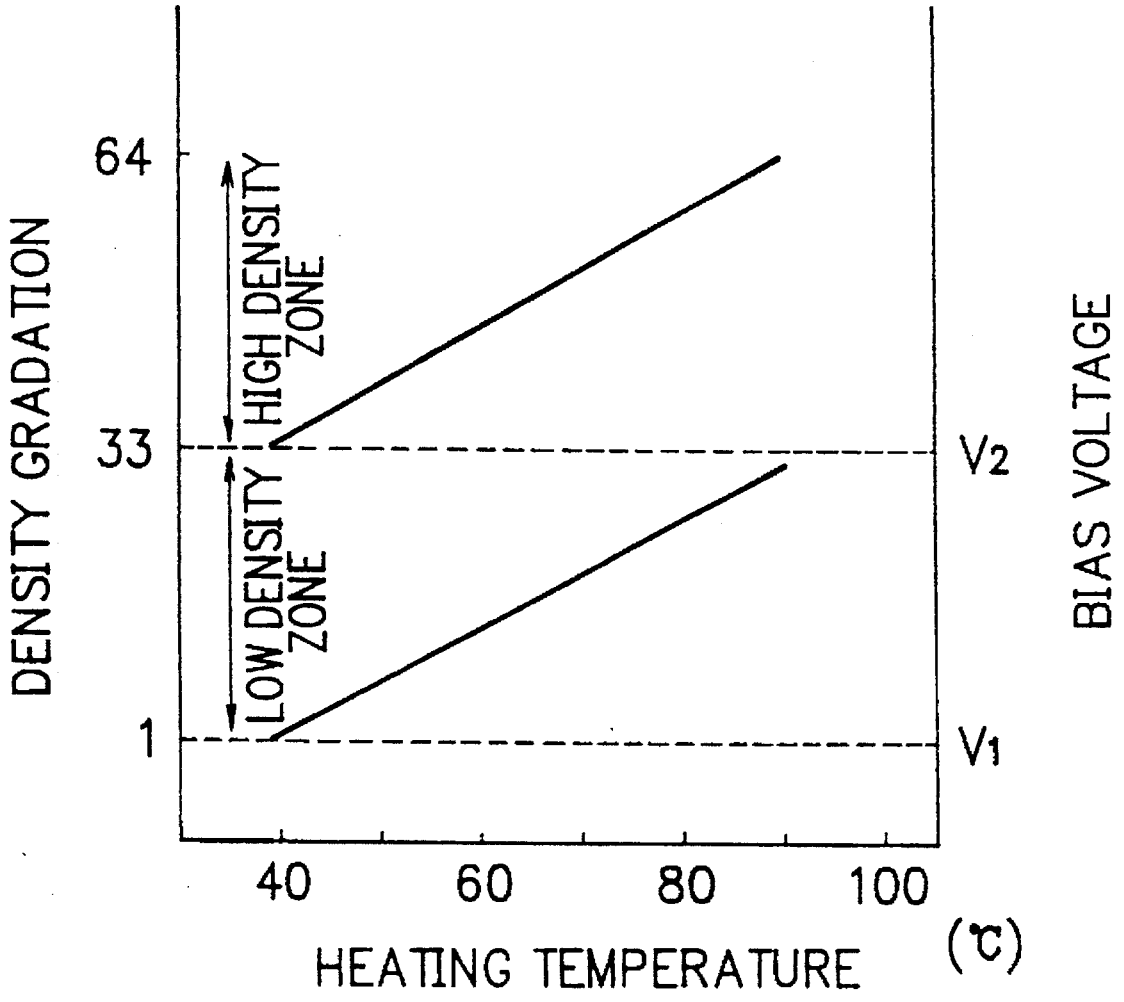
FIG. 16 is a diagram for explaining a gradation control method using the controlling of a bias voltage of charge neutralizing means.

In this embodiment, image data is classified into a plurality of groups according to density such that the bias voltage value of the charge neutralizing means is stepwise varied correspondingly to the classification steps, thereby improving the gradation printing characteristic. Referring now to FIG. 16, description will be given of the printing procedure in an example in which the bias voltage takes two values in a two-step operation to control 64 gradation steps.

First, image data is subdivided into two groups according to density, namely, image data groups respectively related to gradation levels 1 to 32 and gradation levels 33 to 64, respectively.

Subsequently, a bias voltage $V_1$ is applied to the conductive layer 65 as charge neutralizing means so that the first density is attained when the heating element is set to a lower-limit temperature of 40° C. by a bias voltage controller 240 and the 32nd density is obtained when the element is heated to an upper-limit temperature of 90° C. by the bias voltage controller 240. Thereafter, only the image data belonging to the lower-density group is sent to a controller 160 to accomplish processes of generating a latent image and developing and transferring the latent image so as to record the image on a sheet of printing paper (a lower-density zone of FIG. 16).

Next, the bias voltage is varied to $V_2$ so that the 33rd density is attained when the heating element is set to a lower-limit temperature and the 64th density is obtained when the element is heated to the upper-limit temperature. Image data of the higher-density group is then subjected to the printing process to superimpose the resultant image onto the image beforehand produced on the printing sheet (a higher-density zone of FIG. 16).

As above, the image data is classified into a plurality of groups according to density to produce the image a plurality of printing operations while applying a bias voltage to the charge neutralizing means according to the groups. As a result, the dynamic temperature range can be substantially expanded to accomplish the gray-scale printing with a larger number of gradation steps. In the example, since each 50° C. temperature range is subdivided into 32 subranges, the temperature control precision is represented as ±0.8° C. Namely, thanks to the image data classification, the required temperature precision can be reduced to half that of the case in which the image data is not classified. With this provision, the gradation levels can be controlled with an improved stability.

In the image printing operation, when the number of groups of image data is increased to attain a larger number of steps of the bias voltage applied to the charge neutralizing means, the gradation printing characteristic can be further improved.

Although the printing method of the embodiment is disadvantageous with respect to the printing speed. The method is quite advantageous when a high picture quality is required in the image printing operation.

In this regard, the printing procedure is not restricted by that of the embodiment. For example, depending on the heating and charge neutralizing methods. Namely, only the latent image creating process may be carried out in several operation steps, whereas each of the developing and transferring processes is carried out in one operation step.

In accordance with the above embodiment, the multi-level gradation printing can be conducted with high stability and hence there can be attained a gray-scale record image having favorable smoothness in printing density.

Description has been given in detail of embodiments in accordance with the present invention. However, the present invention is not restricted only by the embodiments. For example, although a line-type thermal head is adopted for the heating means in the embodiments, there may be employed any kinds of heating means including a serial-type thermal head, laser beam, heating lamp using, e.g., optical shutters, and flash heating element.

The latent image charge keeping medium is configured in the form of a belt in the embodiments. However, the similar advantageous effect can also be attained by using the medium in any other forms, for example, those of a drum and flat plate.

Furthermore, although a sheet of paper is adopted as the printing medium in the embodiments above, it will be appreciated that there may be adopted any types of printing media in accordance with the present invention.

Additionally, the transfer and fixing steps of the toning medium onto the printing medium may be dispensed with. Namely, the present invention is also applicable to apparatuses such as an indication board in which the toning medium is temporarily kept retained on the printing medium or latent image charge keeping medium so as to display information thereon for a predetermined period of time.

Moreover, although coloring particles (i.e., powdered toner particles) are utilized as the toning medium in the above embodiments, there may also be adopted any other coloring media such as a liquid toner and a liquid ink.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An image printing apparatus, comprising;

a latent image charge keeping medium including a pyroelectric layer;

heating means for selectively heating the charge keeping medium according to a signal; and charge neutralizing means disposed to be brought into contact with or to be in the proximity of a surface of the pyroelectric layer of the charge keeping medium for being heated by the heating means, thereby neutralizing charge appearing on the charge keeping medium due to pyroelectric effect.

2. An image printing apparatus in accordance with claim 1, further comprising;

developing means for visualizing with a charged toning medium an electrostatic latent image formed on the charge keeping medium; and transfer means for transferring the developed image onto a printing medium, the charge neutralizing means including an electrically conductive film.

3. An image printing apparatus in accordance with claim 2, wherein the electrically conductive film is being relatively moved, in a process of forming a latent image on the charge keeping medium or in a process of heating the charge keeping medium, relative to the heating means in a same direction in which the charge keeping medium is moved.

4. An image printing apparatus in accordance with claim 2, wherein the electrically conductive film is a film configured in the form of an endless contour.

5. An image printing apparatus in accordance with claim 2, wherein the electrically conductive film is a film configured in the form of a belt.

6. An image printing apparatus in accordance with claim 2, wherein the electrically conductive film is made of a polymeric substance to which electrically conductive fine particles are added.

7. An image printing apparatus in accordance with claim 2, wherein the electrically conductive film is of a laminated configuration including at least a thin film layer made of an electrically conductive material and a layer made of a polymeric substance for supporting the thin film layer.

8. An image printing apparatus in accordance with claim 2, wherein the electrically conductive film includes a layer made of a thermally anisotropic material having higher thermal conductivity in a direction of thickness of the layer.

9. An image printing apparatus in accordance with claim 1, wherein a surface of the electrically conductive film to be brought into contact with the charge keeping medium is made of an electrically conductive substance having high flexibility equivalent to a gum rigidity of 60 degrees or less.

10. An image printing apparatus in accordance with claim 1, wherein the heating means is a thermal head including heat producing small elements of which temperature is increased according to Joule heat.

11. An image printing apparatus in accordance with claim 1, wherein the heating means is a laser beam controlled according to the signal.

12. An image printing apparatus in accordance with claim 1, wherein the charge keeping medium includes a film configured in the form of an endless contour, the film including a pyroelectric layer and an electrically conductive layer.

13. An image printing apparatus in accordance with claim 1, wherein the charge keeping medium includes an electrically conductive drum and a pyroelectric layer fabricated on a surface of the drum.

14. An image printing apparatus in accordance with claim 1, further comprising means for applying a bias voltage to the charge neutralizing means for generating an absorbing or repulsive force for excessive charge on the surface of the pyroelectric layer.

15. An image printing apparatus in accordance with claim 14, further comprising means for sensing temperature of the heating means and means for controlling a value of the bias voltage applied to the charge neutralizing means according to data of temperature sensed by the sensing means.

16. An image printing apparatus in accordance with claim 1, further comprising means for applying an alternating-current voltage to the charge neutralizing means.

17. An image printing apparatus in accordance with claim 16, wherein the voltage applying means applies, in addition to the alternating-current voltage, a direct-current voltage component to the charge neutralizing means, the direct-current voltage component being superimposed onto the alternating-current voltage.

18. An image printing apparatus in accordance with claim 16, wherein the voltage applying means includes sense means for sensing information of at least one of temperature in the apparatus, humidity in the apparatus, and base temperature of the heating means and voltage control means for controlling a voltage value of the direct-current voltage component according to the sensed information.

19. An image printing method of printing an image by the image printing apparatus according to claim 14, comprising the steps of:

subdividing data of the image into a plurality of sets of image data according to density of pixels to be recorded; and controlling for each of the image data sets the bias voltage and an amount of heat produced by the heating means and achieving a plurality of times a process of forming an electrostatic latent image for each of the image data sets, thereby printing the image data having gradation levels of density.

* * * * *